US005641538A

United States Patent [19]

Caffrey et al.

[11] Patent Number: 5,641,538

[45] Date of Patent: Jun. 24, 1997

[54] APPARATUS AND METHOD FOR SELECTIVELY METERING DRESSING ONTO A BOWLING LANE SURFACE

[75] Inventors: Stephen F. Caffrey, Arvada; Ronald L. Smith, Boulder; Leonid Feldman, Broomfield; Steven W. Stuart, Arvada, all of Colo.

[73] Assignee: AMF Bowling, Inc., Golden, Colo.

[21] Appl. No.: 547,171

[22] Filed: Oct. 24, 1995

Related U.S. Application Data

[63] Continuation-in-part of Ser. No. 337,945, Nov. 10, 1994, Pat. No. 5,517,709.

[51] Int. Cl.[6] ..... B05D 5/12

[52] U.S. Cl. ..... 427/8; 427/428; 427/429

[58] Field of Search ..... 427/8, 428, 429

[56] References Cited

U.S. PATENT DOCUMENTS

| | | | |
|---|---|---|---|
| 3,217,347 | 11/1965 | Domecki | 15/51 |
| 4,700,427 | 10/1987 | Knepper | 15/319 |
| 4,766,016 | 8/1988 | Kubo | 427/428 |
| 4,959,884 | 10/1990 | Ingermann et al. | 15/302 |
| 4,980,815 | 12/1990 | Davis | 364/140 |
| 5,161,277 | 11/1992 | Ingermann et al. | 15/98 |
| 5,181,290 | 1/1993 | Davis et al. | 15/98 |
| 5,185,901 | 2/1993 | Davis et al. | 15/98 |
| 5,243,728 | 9/1993 | Smith et al. | 15/98 |
| 5,274,871 | 1/1994 | Smith et al. | 15/98 |

*Primary Examiner*—Shrive Beck
*Assistant Examiner*—David M. Maiorana
*Attorney, Agent, or Firm*—Fields & Johnson, P.C.

[57] ABSTRACT

An apparatus applies dressing fluid to a bowling lane surface in a desired lane dressing pattern laterally across a plurality of zones on the bowling lane and longitudinally along a predetermined length of each of the zones. Each zone may be the width or a selected fractional width of one board across the bowling lane so that different discrete amounts of lane dressing can be applied to each board along a predetermined length. The apparatus includes a plurality of metering devices which supply lane dressing to corresponding lane dressing dispersion units which in turn supply lane dressing directly to an applicator. The applicator applies the lane dressing to the bowling lane according to the desired lane dressing pattern. A method is provided to supply discrete amounts of bowling lane dressing at desired incremental locations laterally across and longitudinally along a bowling lane. Further, a method is provided for calibration of the apparatus of this invention in order to achieve application of complex lane dressing patterns to the bowling lane.

15 Claims, 13 Drawing Sheets

80
78
74
82
80
90
76
86
82
190
74
71
82
72
86
71

60
56
SUPPLY
68
67

48
61
69
FILTER
70
71
74
69
63
64
69
66
62
65
92
70
71
74
CONTROLLER
69
12 → 39
0000·····0000
94
72

APPARATUS AND METHOD FOR SELECTIVELY METERING DRESSING ONTO A BOWLING LANE SURFACE

TECHNICAL FIELD

This application is a continuation-in-part of U.S. Ser. No. 08/337,945, filed Nov. 10, 1994 and entitled "Apparatus for Selectively Metering Dressing Onto a Bowling Lane Surface" now U.S. Pat. No. 5,517,709.

This invention relates to an apparatus and method for applying lane dressing to a bowling lane and more particularly to an apparatus and method for selectively applying desired amounts of lane dressing at incremental locations to each individual board laterally across and longitudinally along a bowling lane. Furthermore, this invention relates to a method of calibrating the apparatus enabling it to apply complex lane dressing patterns to the bowling lane.

BACKGROUND ART

Many types of bowling lane maintenance machines have been developed for the purpose of applying bowling lane dressing to a bowling lane in a predetermined lateral pattern across the lane. In many cases, the apparatus was developed in response to rules laid down by the American Bowling Congress. As these rules have changed, new lane maintenance machines were developed to accommodate these rules. Under current rules, virtually any lane dressing application pattern is permissible as long as the pattern adheres to the "three unit rule" which requires that, where lane dressing is applied, it must be applied in a quantity of at least three units. According to the rules promulgated by the American Bowling Congress, a unit of lane dressing is 18 microns or 7.1 micro inches thick. Therefore, it is desirable to have a lane maintenance machine which can apply lane dressing to a lane in virtually any desired pattern. Prior art devices exist which provide some variation in the application of the lane dressing pattern laterally across the bowling lane, but none provide complete versatility, especially in application of lane dressing in combined lateral and longitudinal directions. It is also desirable to have a machine which is simple and reliable, yet is capable of applying a complex pattern of lane dressing.

Ingermann, et al., U.S. Pat. No. 4,959,884, provides an oil transfer device for transferring lane dressing from a reservoir to an applicator roller. The device includes pressure fingers which can be adjusted to vary the amount of lane dressing transferred from the reservoir to a transfer roller by a wick. For any given pressure across the transfer roller, the amount of lane dressing applied from the transfer roller to the applicator roller is strictly a function of the speed of the transfer roller. Thus, varied lateral lane dressing profiles can be achieved, but there is no means to simultaneously control longitudinal application of lane dressing.

Davis U.S. Pat. No. 4,980,815 discloses a lane maintenance machine which has a plurality of discharge heads which are each movable laterally across a portion of the apparatus for discharging a predetermined amount of lane dressing onto a roller assembly as the discharge head moves across a portion of the apparatus. This device is intended to provide precise control of application of lane dressing to each portion of the transfer roller and to provide controlled variable amounts of lane dressing across each portion. Although a fairly precise lateral profile can be achieved, there are no effective means provided for varying longitudinal applications, especially for a "step" tapered application wherein there are sharp differences in the amount of lane dressing applied at incremental longitudinal locations along varying sections of the bowling lane. Incremental longitudinal control is made difficult because the discharge of lane dressing onto the roller assembly occurs prior to the machine moving along the bowling lane during lane dressing application.

Ingermann, et al., U.S. Pat. No. 5,161,277, provides a variable speed transfer roller for applying lane dressing from a reservoir to an applicator roller. By varying the speed of the transfer roller, the amount of dressing applied across the applicator roller can also be varied. However, the change is uniform laterally across the applicator roller and hence laterally across the bowling lane.

Davis U.S. Pat. No. 5,181,290 discloses an apparatus for applying lane dressing in which the reservoir has a plurality of wicks extending from the top thereof, each of which can be selectively controlled to bring them into and out of contact with the transfer roller to apply lane dressing selectively across a distance equal to the width of each wick. This apparatus is capable of some lateral and longitudinal control of lane dressing application, but does not provide for application of lane dressing in predetermined amounts to each board laterally across the bowling lane.

Smith, et al., U.S. Pat. No. 5,243,728, discloses an apparatus which has a segmented transfer roller wherein each segment can be driven at different speeds. By varying the speed of the different segments, different amounts of lane dressing can be applied across different portions of the bowling lane. This apparatus is capable of some longitudinal and lateral control of lane dressing applications, but does not provide means for selectively varying the lane dressing on each board both laterally across a bowling lane and longitudinally along the bowling lane.

Smith, et al, U.S. Pat. No. 5,274,871, discloses an apparatus which has a segmented transfer roller comprising a plurality of roller segments. A plurality of pivotally mounted reservoirs are provided, one reservoir corresponding in length with each roller segment and being mounted for pivotal movement to bring its wick into and out of operative contact with the respective roller segment. This arrangement provides more possible variations in the application of lane dressing to a bowling lane but still does not permit the application of different amounts of lane dressing to each individual board in combined lateral and longitudinal applications.

DISCLOSURE OF THE INVENTION

In accordance with the present invention, an apparatus for applying dressing fluid to a bowling lane surface in a discrete pattern laterally across a plurality of zones on the bowling lane and longitudinally along the length of each board of the bowling lane is provided. In the most broad disclosure of this invention, a means is provided for transferring dressing fluid directly to an applicator wherein a selected amount of fluid is discharged from a fluid confining area, such as a chamber, to the applicator. A carriage, for movement along a bowling lane, has the applicator mounted across it for applying the dressing fluid to the bowling lane surface. Dressing fluid is supplied from a reservoir by means of a compressor which pressurizes the fluid into a manifold which then supplies the fluid to a plurality of pulse valves. Each pulse valve then communicates with a corresponding plurality of fluid dispersion chambers, each chamber having an inlet connected to one of the pulse valves and having an outlet positioned to apply dressing fluid to the applicator. In a preferred embodiment, the outlet has a width equal to the width of one of the zones. The size of the outlet, however, may be sized to conform to the exact desired width of application wherein the outlet could span multiple zones or portions of zones. An onboard computer or controller is provided for selectively activating each of the pulse valves to discharge a discrete amount of fluid dressing into each dispersion chamber. Conveniently, each zone may be the width of one board across the bowling lane so that different discrete amounts of lane dressing can be applied to each board. The onboard computer selectively varies the activation of each pulse valve to vary the amount of dressing fluid supplied into each dispersion chamber which, in turn, varies the amount of dressing fluid applied to each zone. The controller also determines the amount and location along the length of each board of the bowling lane for application of dressing fluid. The position of the dispersion chambers is adjustable with respect to the applicator roller.

The dispersion chambers can be laterally spaced along an elongated bar. An elongated plate extends along the bar over the dispersion chambers and is attached to the bar to form a cover for the dispersion chambers.

The manifold can be formed in or along the elongated bar or can be a separate element mounted generally parallel thereto. The space between the elongated bar and the cover plate form outlet dispersion slits through which the lane dressing fluid is dispensed directly onto the applicator roller. Conveniently, each of these dispersion slits may be the same width as one or more of the boards on the bowling lane or portion of the boards. With this arrangement, there is a pulse valve for each dispersion chamber so the different amounts of lane dressing can be applied to any board or to any portion of each board along the desired length of the bowling lane. With this apparatus, virtually any variation in lane dressing application can be provided laterally across and longitudinally along the bowling lane surface.

In one of the embodiments, the dispersion chambers are formed as hollowed out portions in the upper surface of the elongated bar. In another embodiment, the dispersion chambers are formed by cut out portions in a gasket positioned between the elongated bar and the cover plate. In the later embodiment, diffusion means are provided in the form of diffusion baffles, and a diffusion barrier that is formed in the gasket.

Since the apparatus or method of this invention utilizes no transfer rollers or other transfer means in order to transfer lane dressing to the applicator, the apparatus is structurally simpler with fewer moving parts. Accordingly, the apparatus is more easily maintained.

Furthermore, in accordance with the present invention, a method for applying lane dressing fluid to a bowling lane surface in a discrete pattern laterally across a plurality of zones of the bowling lane and longitudinally along the length of each board of the bowling lane is provided. According to this method, a database is created for storage of information reflective of the desired amount of lane dressing to be applied at incremental locations laterally across and longitudinally along the bowling lane. The database may be stored in a memory function of the central processing unit (CPU) of the onboard computer. Data may be selectively retrieved from the memory corresponding to a desired lane dressing pattern to be applied to the bowling lane. A plurality of lane dressing dispersion devices are activated in response to the retrieved data to apply lane dressing according to the desired lane dressing pattern. A graphical display such as a VGA monitor or a liquid crystal display may be mounted adjacent to the onboard computer so that an operator of the apparatus may view graphical data which is reflective of the desired lane pattern.

Finally, a method of calibrating the apparatus of this invention is disclosed wherein the apparatus is calibrated to a level which enables the apparatus to apply lane dressing according to a selected lane dressing pattern. According to the calibration method, once an operator of the apparatus has chosen a desired lane dressing pattern, the lane dressing machine applies a predetermined amount of lane dressing according to the selected pattern. Calibration tape is placed laterally across the bowling lane, at selected longitudinal locations after passing the lane dressing machine down the lane. The calibration tape is then removed to lift off the applied lane dressing. A lane monitoring device measures the amount of lane dressing adhering to the calibration tape. The lane monitoring device communicates directly with the onboard computer to allow the measured amounts to be input as data into the computer. A comparison is made, via an algorithm programmed in the onboard computer, between the measured amount of lane dressing adhering to the calibration tape with that of the desired amount in accordance with the selected lane dressing pattern. A deviation is identified between the amounts adhering to the tape versus the amounts of lane dressing required. An adjustment factor is determined for each pulse valve so that a modified controlling signal from the onboard computer may be sent to the appropriate pulse valve. The lane dressing machine may then be activated for another pass down the lane wherein further measurements can be taken to determine if the desired level of calibration has been achieved.

Additional advantages of this invention will become apparent from the description which follows, taken in conjunction with the accompanying drawings.

BEST MODE FOR CARRYING OUT THE INVENTION

Figure 1:
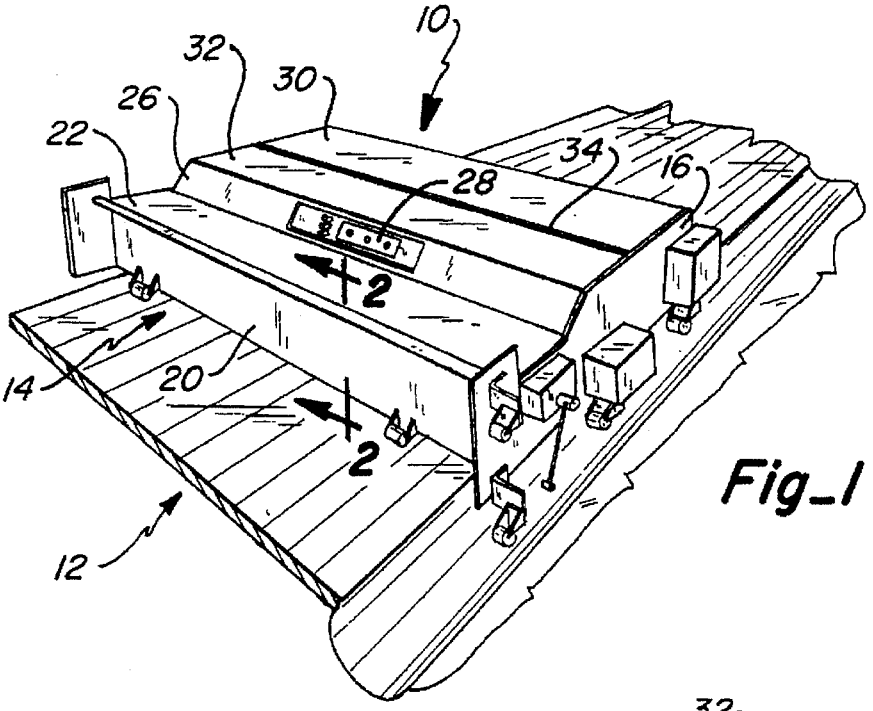
FIG. 1 is a perspective view of a bowling lane maintenance machine incorporating the present invention.
Figure 2:
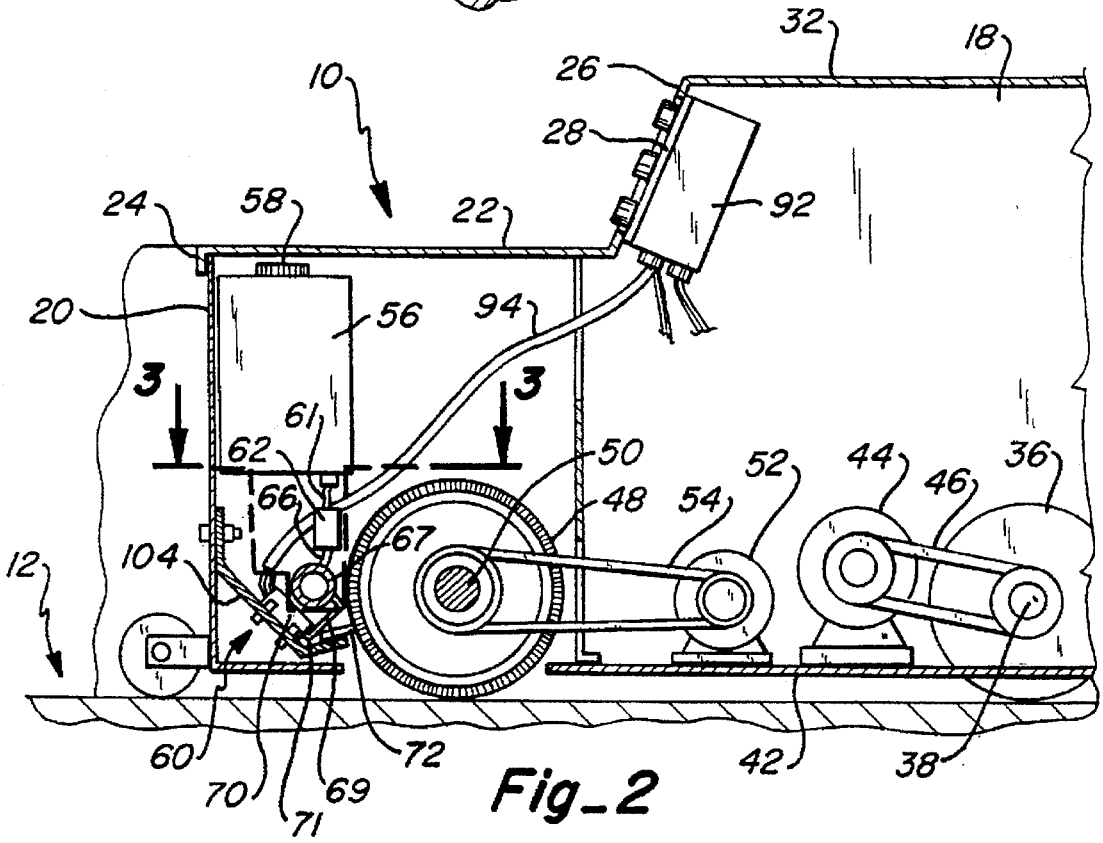
FIG. 2 is an enlarged, fragmentary vertical section, taken along line 2—2 of FIG. 1, showing the dressing fluid applying apparatus of this invention.
Figure 3:
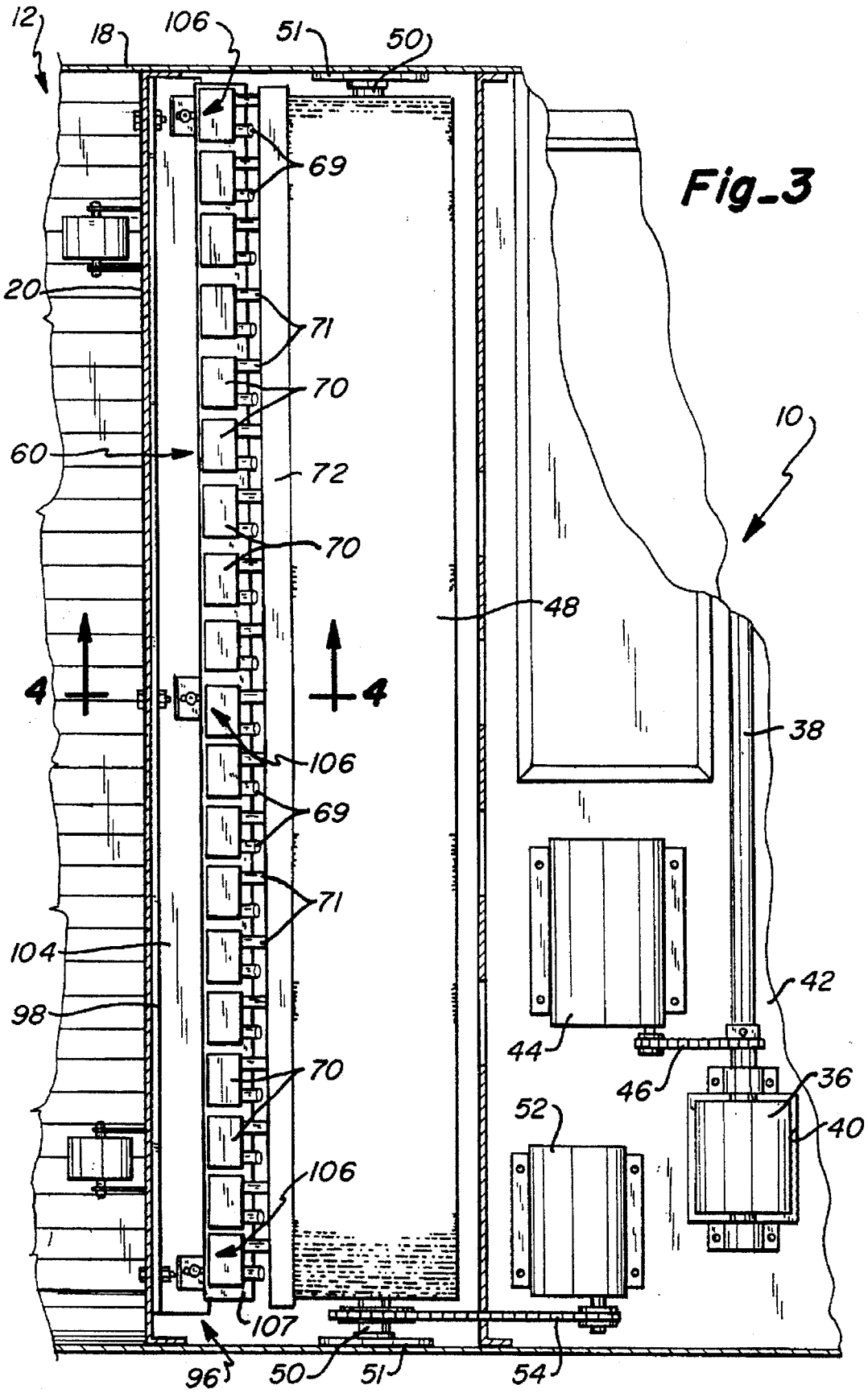
FIG. 3 is a horizontal section, taken along line 3—3 of FIG. 2, showing further details of the invention.

As seen in FIGS. 1–3, a bowling lane dressing apparatus 10 is provided for movement up and down a bowling lane 12 between the foul line and the pit. This apparatus includes a carriage 14 which includes opposite side walls 16 and 18 interconnected by a front wall 20 and a rear wall (not shown). Top cover 22 has a front flange 24 that extends over the upper edge of front wall 20 and terminates at its other side in an upstanding angular wall 26 to which a control panel 28 is mounted for controlling the various functions of the apparatus. The device has an upper cover 30 which has a pivotal section 32 connected thereto as by a panel hinge 34. A pivotal section 32 allows access to the interior of the apparatus for maintenance and repair. Details of the mechanics of this devices, other than those described below, can be found in Ingermann, et al., U.S. Patent No. 4,959,844, for "Combination Bowling Lane Stripper and Dressing Apparatus" which is incorporated herein by reference.

As best seen in FIGS. 2 and 3, carriage 14 is provided with spaced drive wheels 36 interconnected by rotatable shaft 38. The drive wheels 36 extend through openings 40 in bottom wall 42 for engagement with bowling lane 12 for moving the carriage longitudinally along the bowling lane for applying lane dressing. The drive wheels are driven by a motor 44 through a chain drive 46. The applicator or buffer roller 48 is mounted for rotation on a central shaft 50 and is positioned to contact the bowling lane 12 to apply the lane dressing. It is rotated by a drive motor 52 through a chain drive 54. Conveniently, a reservoir 56, shown in FIG. 2, is attached to front wall 20 and is filled with lane dressing through filler cap 58.

Figure 4:
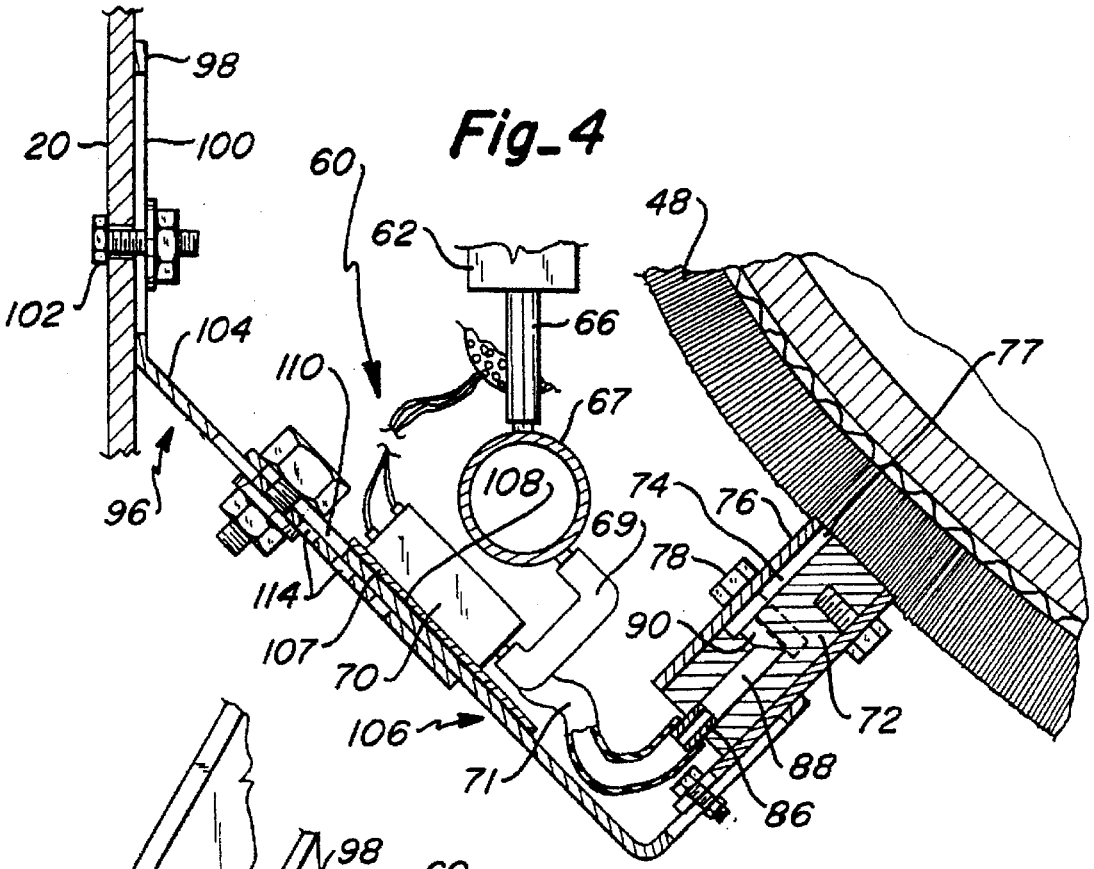
FIG. 4 is an enlarged horizontal fragmentary section, taken along line 4—4 of FIG. 3, showing details of the manifold and dispersion chamber bar.
Figure 6:
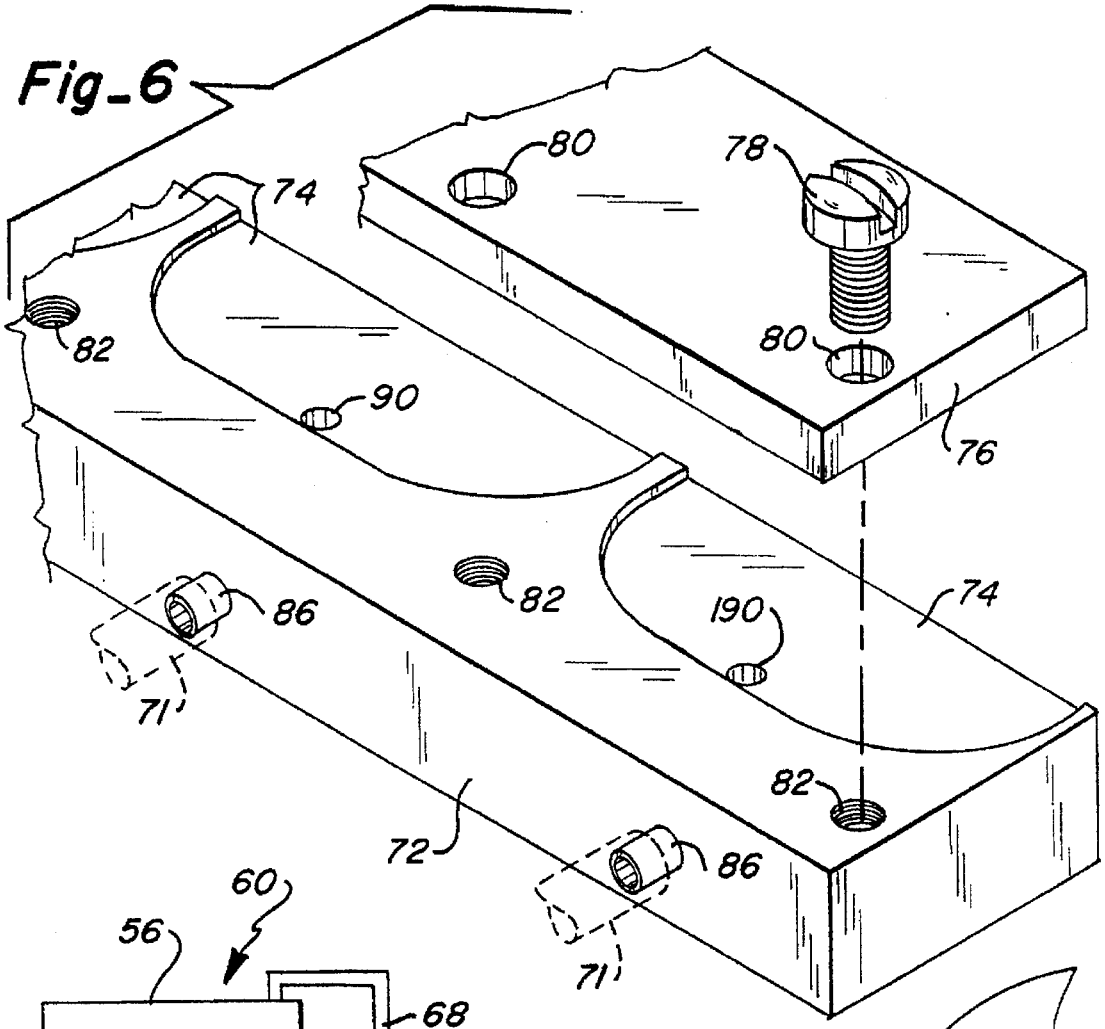
FIG. 6 is a fragmentary, exploded, perspective view of a portion of the dispersion chamber bar showing the dispersion chambers and the cover plate therefor.
Figure 7:
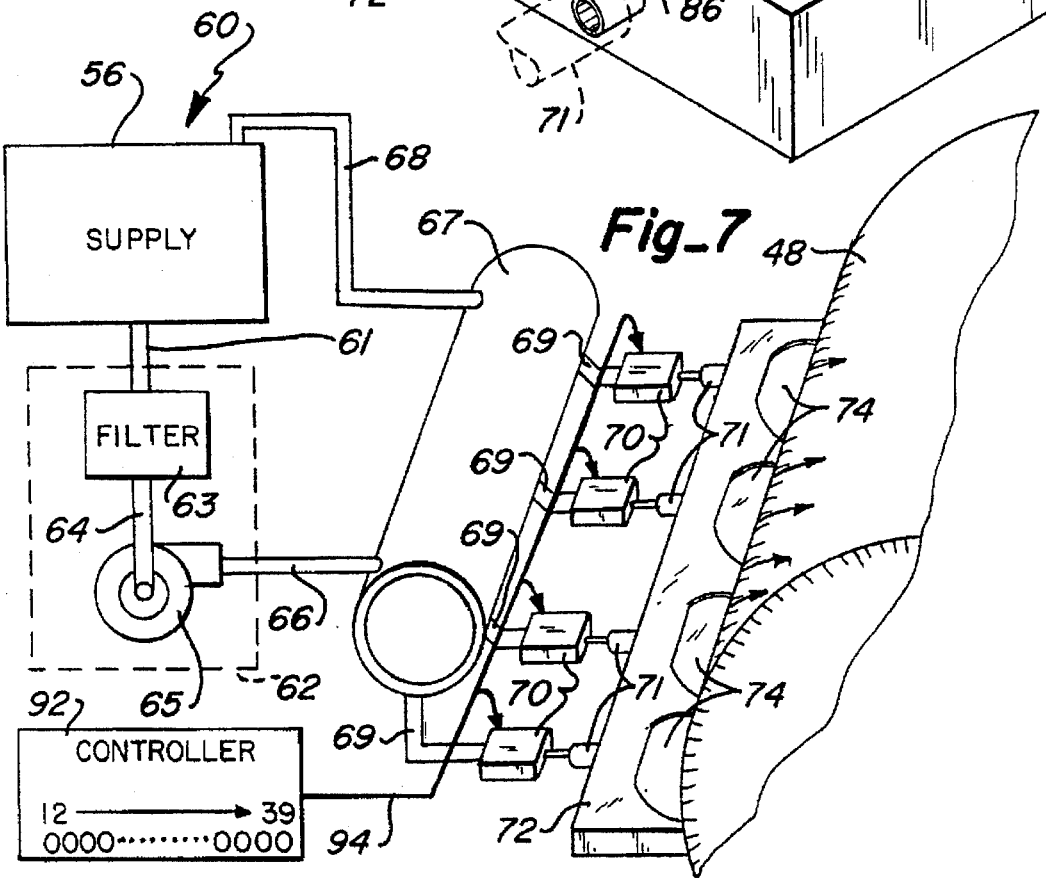
FIG. 7 is a fragmentary diagrammatical view of the fluid circuit and controller for the dressing fluid applying apparatus.

A lane dressing dispersion unit 60 is supplied with lane dressing through a first tube 61 connecting the bottom of reservoir 56 to a pressure system 62 via filter 63, which filters out any impurities that are in the reservoir, as best seen in FIG. 7. A tube 64 connects filter 63 to compressor 65 which in turn supplies lane dressing through discharge tube 66 to manifold 67. A return line 68 is connected to reservoir 56 for returning lane dressing that is not dispersed. The lane dressing is supplied from manifold 66 through a plurality of outlet tubes 69, each of which is connected to a separate one of a plurality of positive displacement pulse valves 70. Each pulse valve has an outlet tube 71 connected to an elongated bar 72 for supplying lane dressing to a plurality of longitudinally spaced dispersion chambers 74 formed therealong. As best seen in FIG. 6, these dispersion chambers can be formed, as by milling. A cover plate 76 extends over elongated bar 72 and forms a cover for each dispersion chamber 74. As shown in FIG. 4, the space between cover 76 and the bottom of dispersion chamber 74 provides an outlet slit 77 through which the bowling lane dressing fluid is discharged onto applicator roller 48. Conveniently, as seen in FIG. 6, top cover 76 is held in place by a plurality of fastening means such as screws 78 extending through holes 80 in the cover plate and into tapped holes 82 in bars 72.

Figure 5:
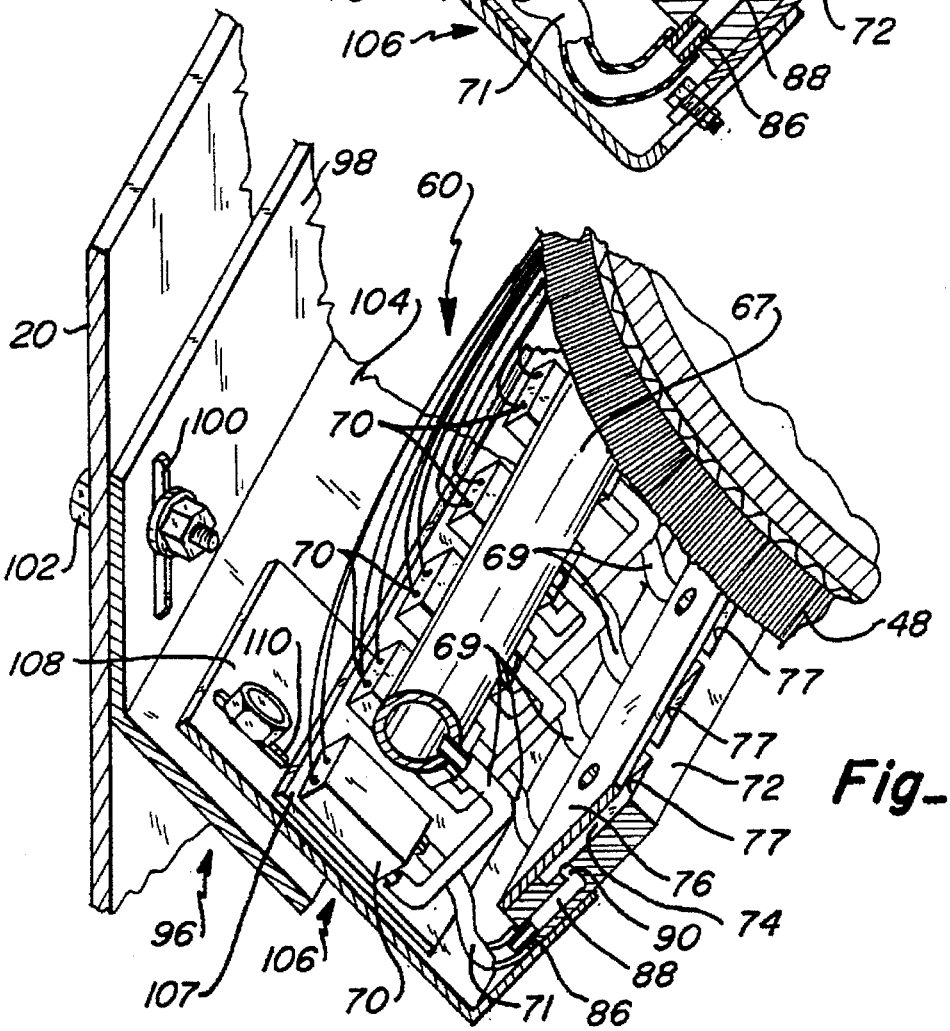
FIG. 5 is a fragmentary perspective view of the apparatus shown in FIG. 4.

Each outlet tube 71 has a distal end connected, respectively to a plurality of tubular connectors 86 which extend from lateral passageways 88 in bar 72, as seen in FIGS. 4 and 5. Each passageway 88 intersects with a vertical port 90 which terminates in dispersion chamber 74. Each pulse valve 70 is controlled by a conventional controller 92, such as an onboard computer or a programmable logic controller (PLC), which is mounted behind control panel 28, as seen in FIG. 2, and which provides suitable electrical signals through electrical wires 94 to selectively activate each individual pulse valve. The pulse valves each receive electrical pulse signals to cause each pulse valve to open the appropriate amount of time to supply the desired amount of fluid to each of the dispersion chambers 74 at incremental times during the operation of the machine. A suitable pulsing frequency has been found to be three Hertz. More specifically, the apparatus and method of this invention uses a pulse width modulation (PWM) control technique to regulate the amount of fluid that flows through each valve. Within this PWM control technique, each valve is turned on and off rapidly. The amount of time that the valve is on, or the pulse width, enables a variable fluid flow rate to be determined by the percentage of time that each valve is on. Thus, upon activation of one of the pulse valves 70, the precise amount of dressing fluid is pumped over the appropriate duration of time corresponding to a longitudinal distance on the bowling lane through discharge conduit 71 and into the dispersion chamber via passageway 88 and port 90. This predetermined amount of fluid dressing applied over a desired time frame is discharged through the outlet slit 77 and onto an applicator, such as applicator roller 48, which in turn applies the dressing to the bowling lane. Stated another way, the controller is able to vary the volummetric flow rate of dressing fluid at incremental times to the respective dispersion chambers by varying the pulse width modulation of each electric pulse the controller sends to each pulse valve.

While the applicator is illustrated as a roller of relatively large diameter, it will be understood by one skilled in the art that other forms of applicators can be used. By way of example only, a roller having a much smaller diameter can be used or the applicator could take the form of a wick, wiper or sponge. In fact, the applicator can be any device which has the ability to transfer a predetermined amount of lane dressing from each of the dispersion chambers to individual zones or boards of the bowling lane surface along a desired longitudinal length thereof.

As best seen in FIGS. 4 and 5, the dispersion unit 60 is adjustably mounted on front wall 20. In this regard, an angle bracket 96 is provided which has a vertical flange 98 with a longitudinal slot 100 therein. A bolt 102 extends through the slot and front wall to hold the bracket in vertically adjustable position. Angle bracket 96 has an angular flange 104 extending outwardly at an angle from vertical flange 98. Attached to flange 104 are a plurality of laterally spaced brackets 106 which support dispersion unit 60. Bracket 106 has an attachment arm 108 with an elongated slot 110 for receiving a bolt 112 which extends through any one of a plurality of spaced holes 114 in flange 104 of bracket 96. It will be apparent that with this arrangement, the bar can be moved to adjust the position of the dispersion chambers with respect to the applicator roller. A support plate 107 extends between brackets 106 to support the pulse valves 70, as shown.

Figure 8:
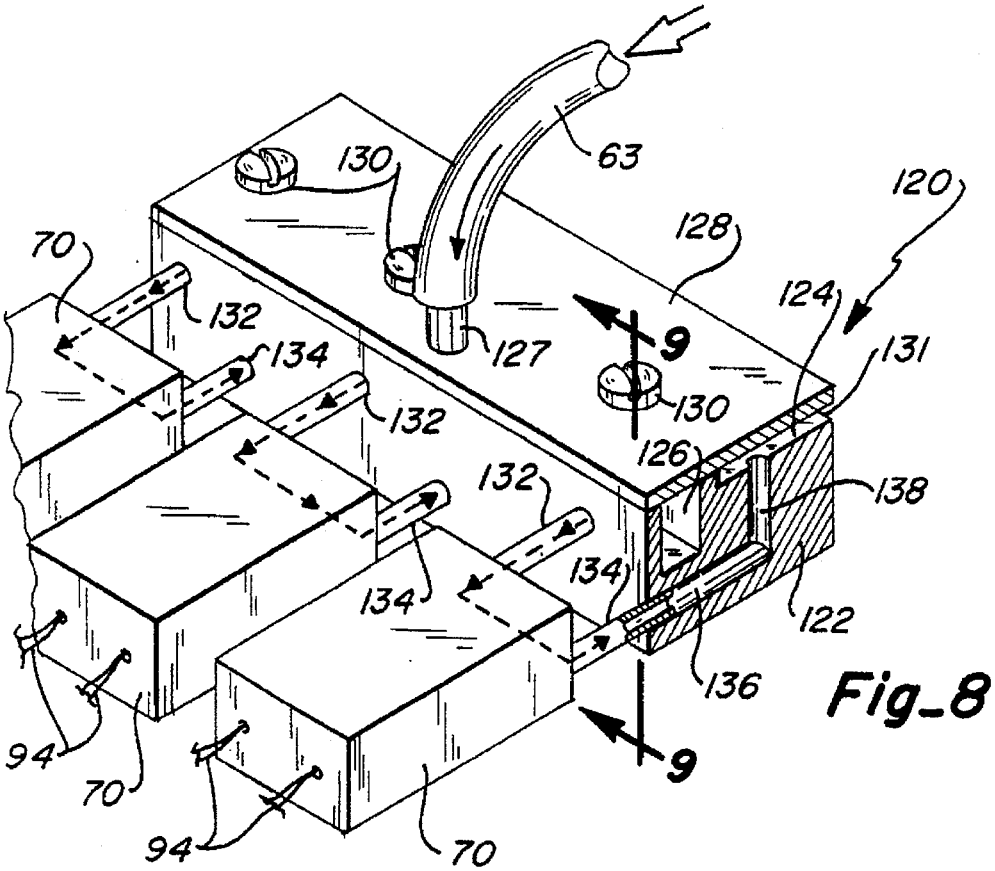
FIG. 8 is a fragmentary perspective view of an alternative dressing fluid applying apparatus.
Figure 9:
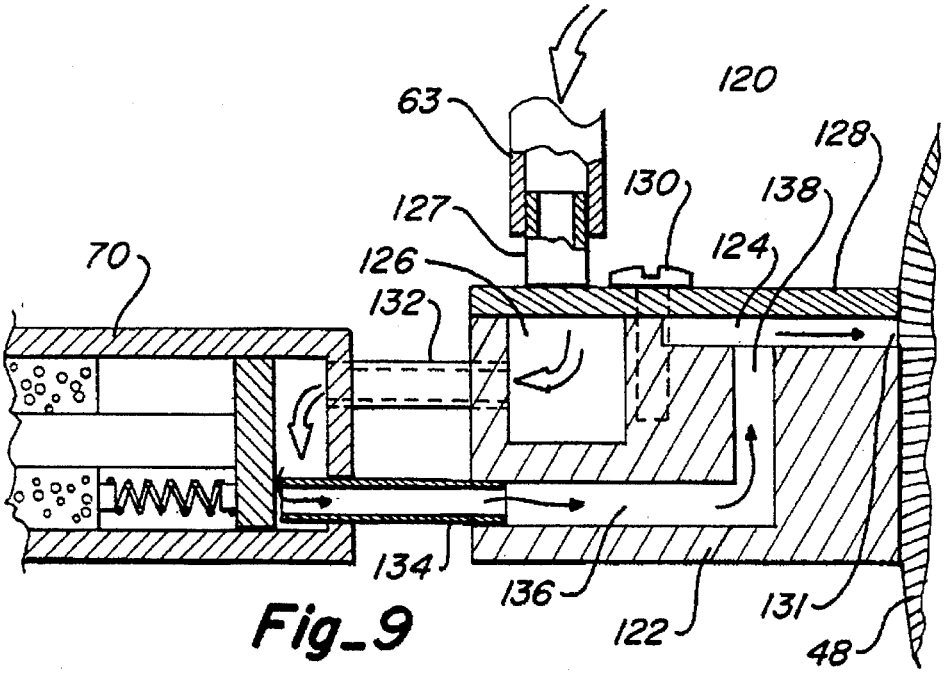
FIG. 9 is an enlarged fragmentary vertical section, taken along line 9—9 of FIG. 8, showing further details of the dressing fluid applying apparatus.

An alternative dispersion unit 120 is shown in FIGS. 8 and 9. In this dispersion unit, an elongated bar 122 has formed above it a plurality of longitudinally spaced dispersion chambers 124. Central cavity 126 is formed integrally in bar 122 behind the dispersion chambers, as shown. Dressing fluid is supplied by tube 63 through an inlet tube 127 in communication with cavity 126. This tube passes through cover plate 128 which is attached over elongated bar 122 to form a cover for dispersion chambers 124 and for cavity 126. It is held in place by a plurality of laterally spaced screws 130. An outlet slit 131 is formed by the gap between coverplate 128 and elongated bar 122. The fluid in cavity 126 is supplied to a plurality of pulse valves 70 by respective conduits 132. This fluid is pumped by each of the pulse valves 70 in discrete incremental amounts through respective outlet tubes 134 which communicates with passageway 136 and port 138 which conveys the fluid to dispersion chamber 124.

Figure 10:
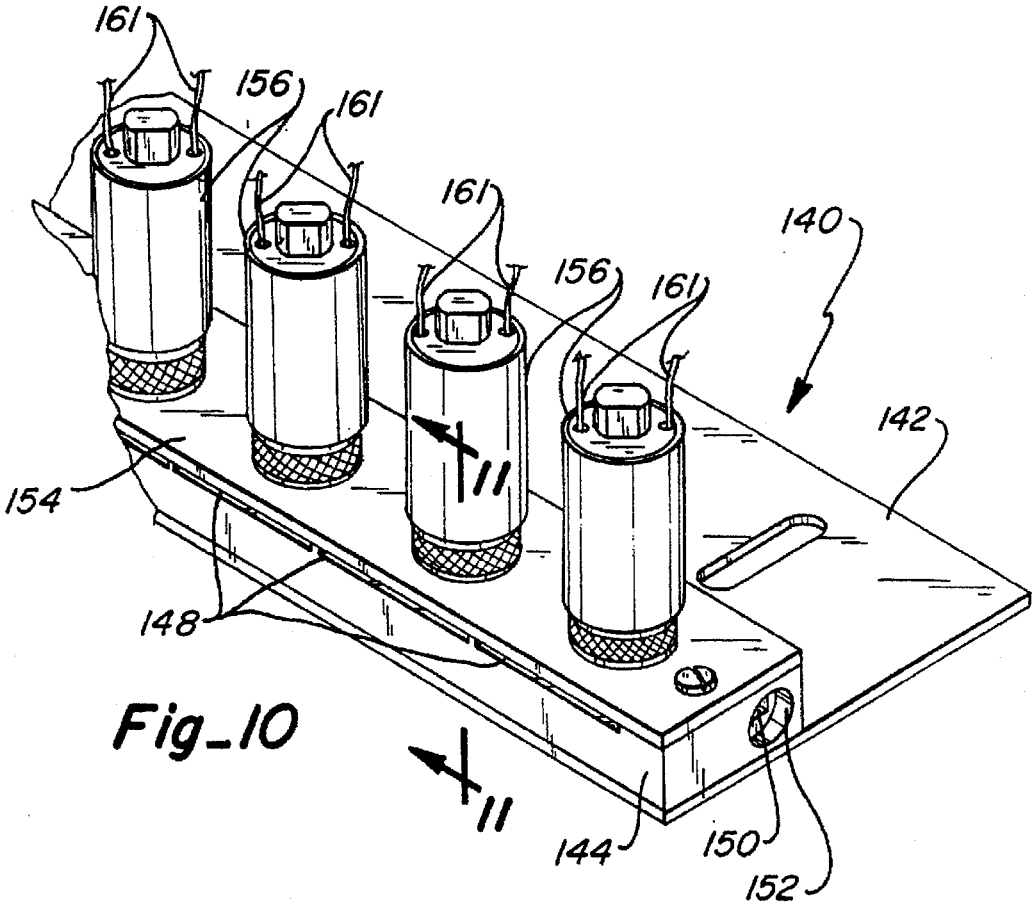
FIG. 10 is a fragmentary perspective view of a further alternative embodiment of a dressing fluid applying apparatus.
Figure 11:
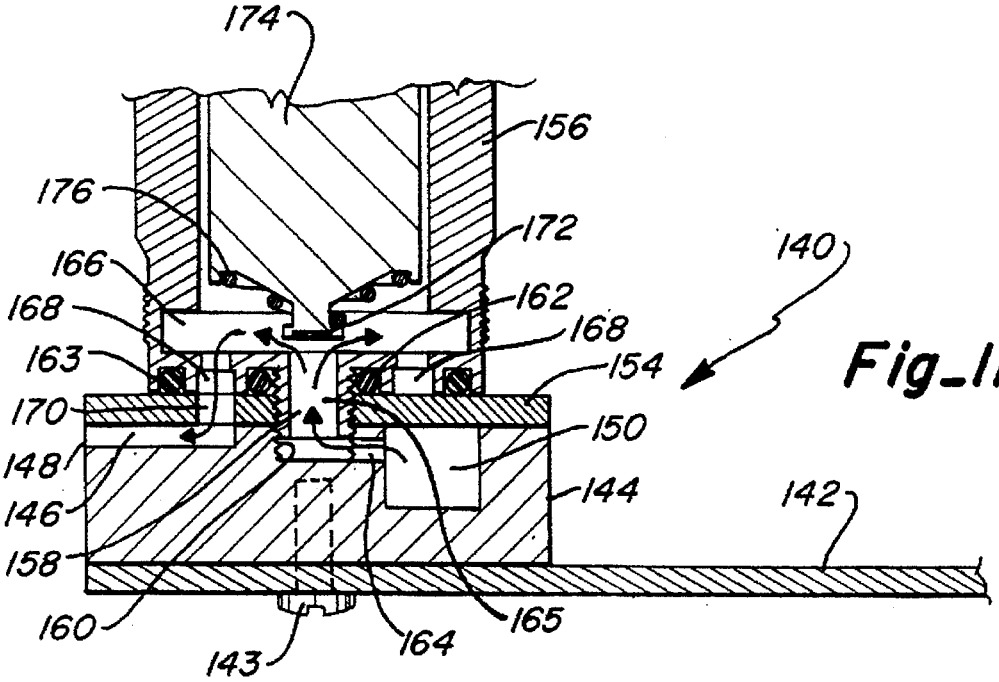
FIG. 11 is an enlarged vertical section, taken along line 11—11 of FIG. 10 showing the internal construction of a control valve.
Figure 12:
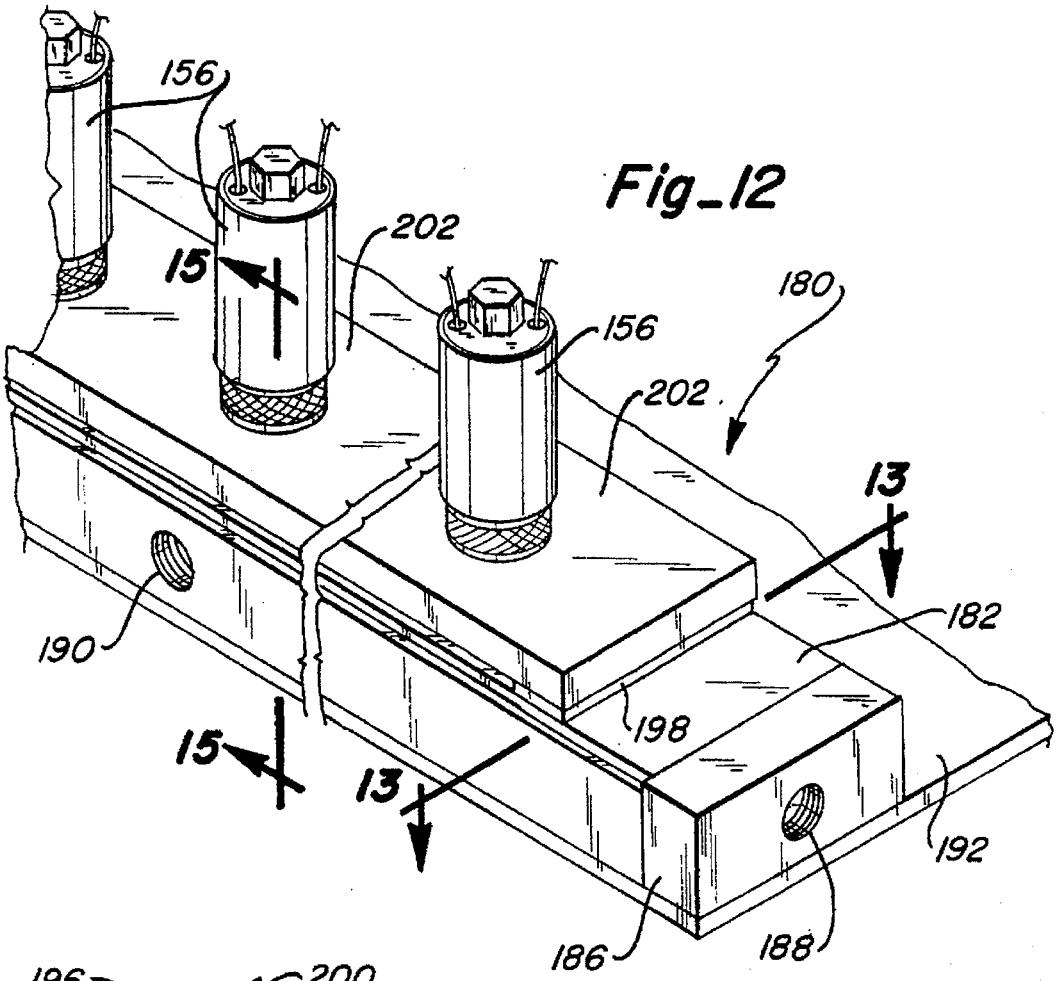
FIG. 12 is a fragmentary perspective view of a preferred embodiment of a dressing fluid applying apparatus.

A still further embodiment is shown in FIGS. 10 and 11 wherein a dispersion unit 140 is attached to a mounting bracket 142 by laterally spaced bolts, such as bolt 143 shown in FIG. 11. An elongated bar 144 extends across bracket 142 and has formed above it a plurality of laterally spaced dispersion chambers, such as dispersion chamber 146, shown in FIG. 11. In addition, central cavity 150 is formed integrally in bar 144 behind the dispersion chambers, as shown. Dressing fluid is supplied through inlet 152 which can be located anywhere along cavity 150 but is shown as being at the end thereof in FIG. 10. A cover plate 154 forms a top for the dispersion chambers 146 and cavity 150 which is held in place by longitudinally spaced solenoid pulse valves 156 and forms a discharge slit 148 at the front of each dispersion chamber 146 for the dressing fluid to be transferred to the applicator roller. Conveniently, each pulse valve 156 has a threaded stem 158 which extends through top cover 154 and is secured in a tapped hole 160 in bar 144. Each pulse valve also includes a pair of electrical leads 161 for connection to a controller, such as controller 92 of FIG. 2. As in the previous embodiments, there is a pulse valve for each dispersion chamber. Each pulse valve has an inner O-ring 162 around stem 158 and an outer O-ring 163, as shown in FIG. 11 to prevent leakage of dressing fluid.

As will be apparent, the dressing fluid flows from cavity 150 through a plurality of lateral holes 164, each communicating with a central passageway 165 in stem 158, and into pulse valve chamber 166 when pulse valve 156 is energized so that it is moved to the open position shown in FIG. 11. The fluid is expelled from chamber 166 through one of the plurality of bottom openings 168 in the bottom of the valve which is aligned with port 170 in cover plate 154 which directs the fluid into dispersion chamber 146. When pulse valve 156 is disengaged, the valve seat 172 will cover the upper end of passageway 165 under the bias of spring 176 to prevent the flow of lane dressing to dispersion chamber 146. Thus, with each pulse of each pulse valve 156, a precise discreet amount of lane dressing will be supplied to the respective dispersion chambers. The pulse width modulation control technique determines the total amount of lane dressing to be supplied at a desired time from each dispersion chamber to the applicator roller 48 which is then transferred by the applicator roller to each board on bowling lane 12.

Figure 13:
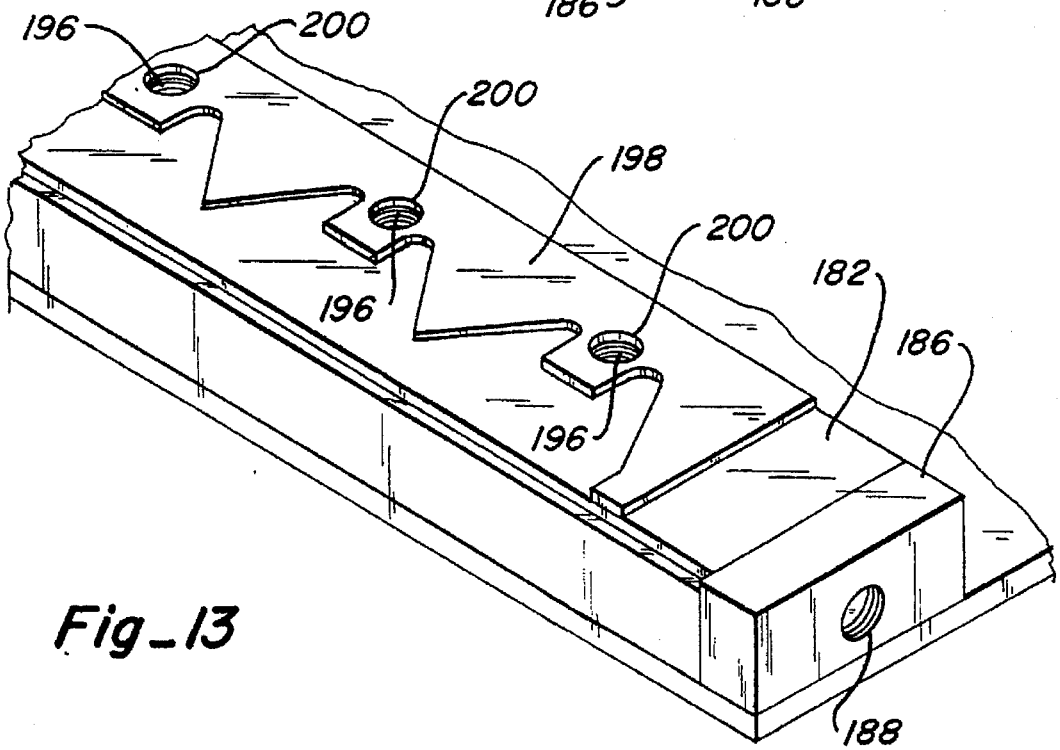
FIG. 13 is a fragmentary perspective view, taken along line 13—13 of FIG. 12, showing details of the dispersion gasket.
Figure 14:
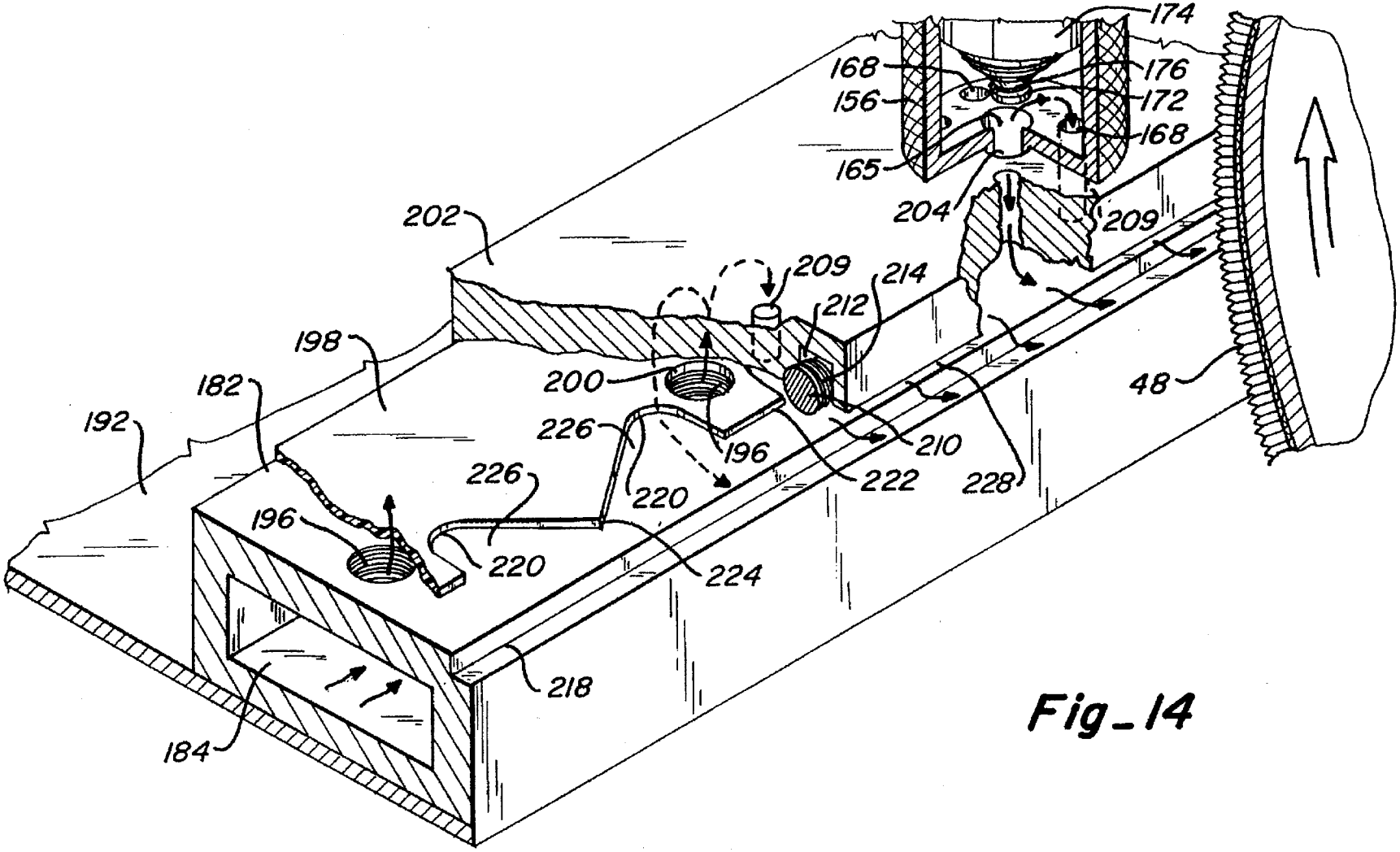
FIG. 14 is a greatly enlarged fragmentary, perspective view of the preferred embodiment with parts broken away to show further details of the invention.

The preferred embodiment of this invention is shown in FIGS. 12–16. A dispersion unit 180 is provided which includes a rectangular tubular bar 182 which has a central cavity 184, as best shown in FIG. 14. The opposite ends of cavity 184 are closed, as by end caps, such as end cap 186. An inlet opening 188 is provided in each end cap for introducing lane dressing fluid from a reservoir such as reservoir 56, shown in FIG. 2. A central opening or vent 190 is provided to purge air from the cavity 184 when it is first filled with dressing fluid. Conveniently, dispersion unit 180 is mounted on a bracket 192, as by a mounting bolt 194 extending through bracket 192 into the bottom or base of bar 182. Advantageously, bar 182 has longitudinally spaced threaded openings 196 in its upper surface.

Figure 15:
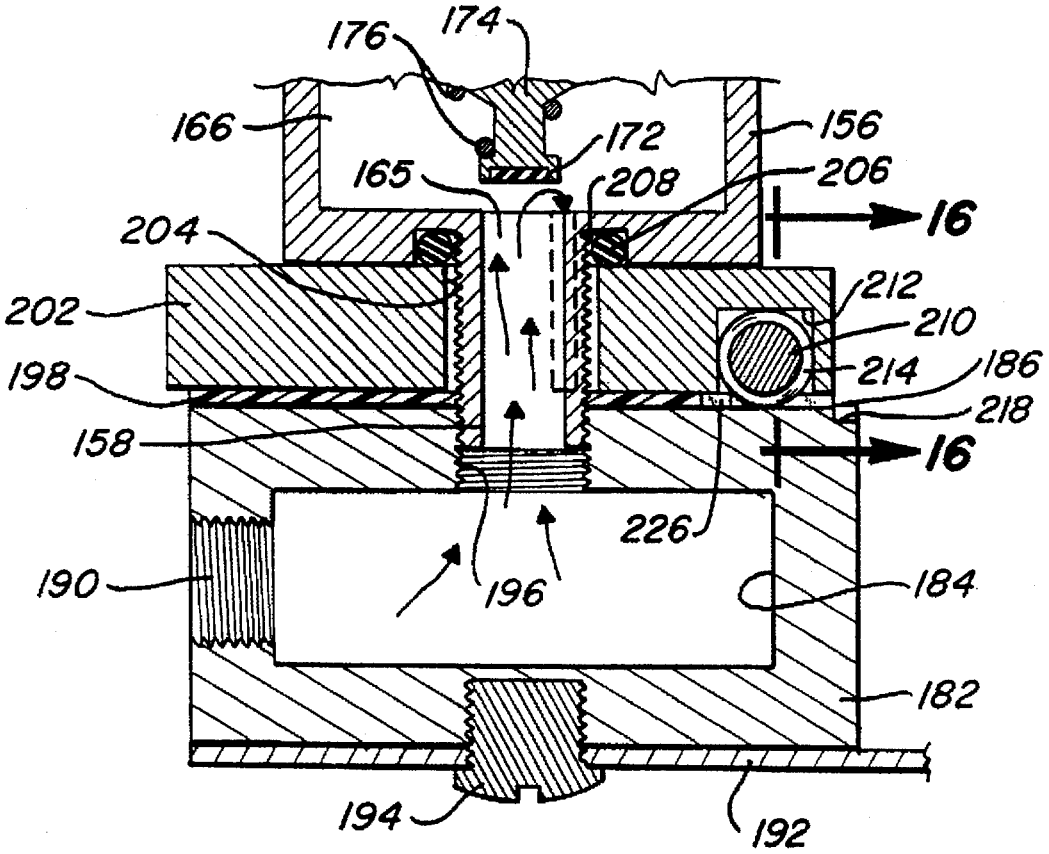
FIG. 15 is an enlarged vertical section, taken along line 15—15 of FIG. 12, showing the flow of the dressing fluid from the manifold through the pulse valve and through the dispersion chambers.

Laying longitudinally along the top of bar 182 is a dispersion gasket 198 which has openings 200 aligned with openings 196, as seen in FIGS. 13 and 14. Gasket 198 may be made of any suitable non-porous material which will not deteriorate over time due to contact with the lane dressing. An elongated cover plate 202 extends across dispersion gasket 198 and has openings 204 aligned with openings 196 and 200 through which the stem 158 of valve 156 extends, as shown in FIG. 15. As can be seen, the threads of stem 158 engage the threaded opening 196 in bar 182 and holds gasket 198 and cover plate 202 in place. To provide a complete seal, an O-ring 206 is provided in a peripheral groove 208 around stem 158 and engages the top surface of plate 202 adjacent opening 202, as seen in FIG. 15. As can be seen in FIG. 14, when a valve 156 is energized so as to be moved to the open or on position shown, lane dressing fluid will flow from cavity 184 through central passageway 165 into chamber 166. From chamber 166, the dressing fluid will be directed downwardly through those openings 168 which are aligned with conduits 209 extending through top plate 202 to be dispersed as described below.

Figure 16:
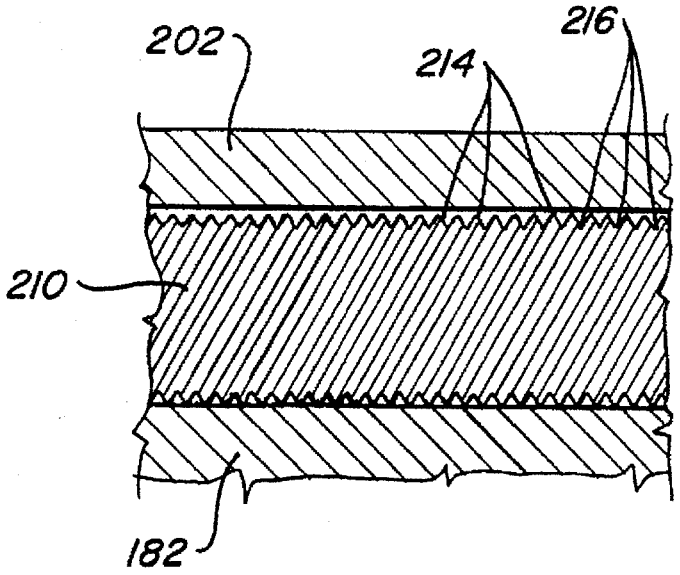
FIG. 16 is an enlarged fragmentary vertical section, taken along line 16—16 of FIG. 15, showing the baffle device for dispersing the fluid evenly through the outlet dispersion slit of the dispersion chamber.

Just forward of dispersion gasket 198 extends a longitudinal dispersion member in the form of a dispersion rod 210 which is contained in a longitudinal groove or channel 212 in the lower surface of cover plate 202, as best seen in FIGS. 14 and 15. As shown in FIG. 16, the dispersion rod 210 has peripheral ribs 214 forming grooves 216 therebetween.

Along the forward edge of bar 182 just forwardly of dispersion rod 210 is a cut or recess 218 for collecting lane dressing fluid and applying it to applicator 48.

Conveniently, when the valve is in the open or on position, fluid dressing will flow through conduits 209 into a curved recess 220 formed in the forward surface of the gasket 198. This recess terminates at one side in a flat surface 222 and at the other side in a pointed end or barrier 224. The dressing fluid dispensed into two adjacent recesses 220 will puddle forwardly from those recesses along the surface of the gasket and will ultimately merge with a puddle from an adjacent recess at barrier 224 or across edge 222. The space between each adjacent point 224 represents the width of one board of the bowling lane. It will be understood that the space between adjacent points 224 may be configured in any desired manner, for example, representing the width of multiple boards or partial widths of boards, in order to selectively apply fluid to any part of the bowling lane. Thus, different amounts of fluid can be dispensed between adjacent points to provide different amounts of fluid to each bowling lane board. As the fluid moves toward the leading edge, it will pass through dispersion rod 210 whose ribs 214 will further create an even flow of fluid into recess 218 where it is picked up by the applicator roller 48 and applied to the lane. The area between the adjacent pointed ends or barriers 224 of gasket 198 and above the upper surface of bar 182 form the respective dispersion chambers 226 from which fluid is dispensed into the recess 218 and onto applicator roller 48, as previously described. The forward edge of the space between adjacent tips 224 forms a slit 228 where the fluid is dispersed between the ribs 214 of dispersion rod 210. Ribs 214 serve a vertical baffles laterally spaced across outlet slits 228 of each dispersion chamber 226 for spreading the lane dressing for even discharge from the respective outlet slits.

Although a separate pulse valve has been shown for each dispersion chamber, it will be understood that one pulse valve could serve a zone comprising more than one dispersion chamber, if desired, as will be apparent to one skilled in the art.

Figure 24:
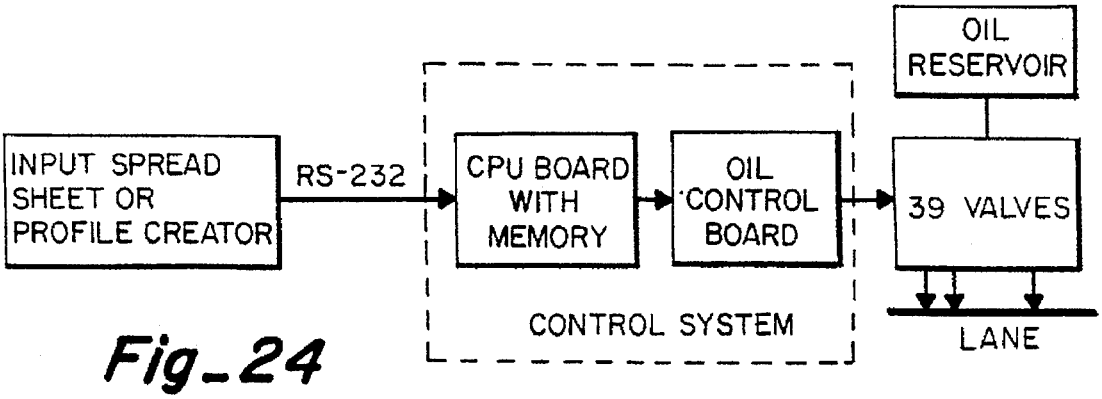
FIG. 24 is a simplified block diagram of the lane dressing application function of the apparatus and method of this invention.
Figure 25:
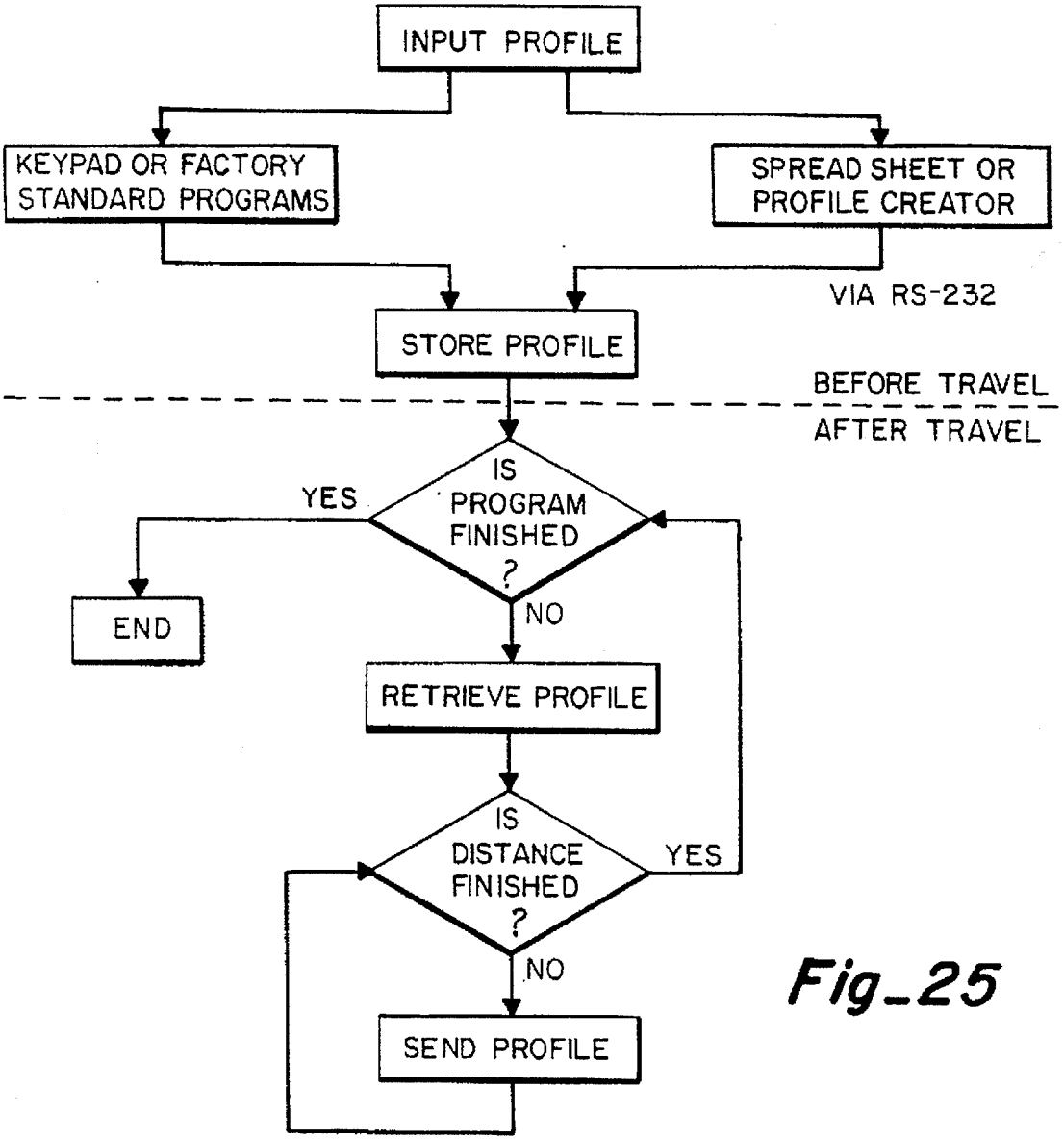
FIG. 25 is a simplified block diagram illustrating the input and storage of a particular lane profile, and the logic programmed within the CPU which results in application of the desired lane profile to the boards of a bowling lane.

According to the method of this invention, a method of applying lane dressing to the boards of a bowling lane is provided wherein complex lane dressing patterns can be applied and which are reflective of incremental amounts of lane dressing dispersed over discrete lateral and longitudinal locations according to a specified lane dressing profile. Referring to FIGS. 24 and 25, the desired pattern is developed by inputting information into the onboard computer reflective of the desired amount of lane dressing to be applied across each lateral and along each longitudinal increment of the bowling lane. A user can choose or create a desired lane dressing profile in four ways. First, the apparatus of this invention is provided with twenty standard lane conditioning programs which are stored in a memory function of the controller or onboard computer. The user can select any of these programs using the appropriate keys on the control panel 28. Second, the user can create a custom profile by manipulating the key pad on the control panel. According to the second way, a software program has been developed to receive lateral and longitudinal profile information as input by the user. Third, a custom profile can be created using a lane dressing profile creator which is a Windows® based graphic user interface. Fourth, a lane dressing profile can be created as a spreadsheet using Microsoft® Excel®. With either the third or fourth way, the custom lane dressing profile is downloaded into the memory of the CPU of the onboard computer as by an RS-232 communications cable. Each of the four methods enable an operator to input data in terms of units of lane dressing wherein the required outputs to the pulse valve are based not only upon the amounts of lane dressing to be applied at specific incremental locations, but also based upon other variables such as the machine speed along the bowling lane, the pressure of the lane dressing flowing through the pulse valves, lane dressing viscosity, retention of lane dressing on the applicator, and the individual performance characteristics of each of the pulse valves. The lane dressing profile data inputted by the operator may be stored as a database in a memory function of the CPU. As desired, the stored profile information may be updated to add, delete or modify a particular lane dressing pattern. A VGA monitor or liquid crystal display may be incorporated within the control panel 28 to enable an operator of the machine to visually observe the particular lane dressing pattern chosen for application. The monitor is simply coupled to the onboard computer by means of an appropriate cable which transmits imaging data to the monitor. FIGS. 17 through 22 are some three-dimensional representations of examples of lane dressing patterns which may be displayed for the operator. Each of these example profiles can be assigned a specific identifying code wherein the operator simply inputs the code to have the maintenance machine apply the corresponding pattern. Alternatively, as mentioned above, the operator could manually input a desired pattern which may then be stored in the memory function. Thus, an operator is able to view lane profile information as stored by the onboard computer through a graphical representation. As shown in FIG. 25, once the desired pattern has been chosen by the operator, data responsive thereto is retrieved from the memory. For a selected input profile, the CPU receives the corresponding lane dressing unit thickness array and converts it from unit thicknesses to corrected pulse width modulation values. At each incremental length along the bowling lane, the CPU sends the appropriate 39 pulse width modulation values to the lane dressing control board as set forth in the corresponding array. Each of these values corresponds to a board at that particular incremental distance. The lane dressing control board contains the circuitry necessary to drive an output signal to the 39 valves. That is, the lane dressing control board cycles the pulse valve on and off according to the pulse width modulation values. At each incremental length along the bowling lane, the lane dressing control board controls the pulse valves until the chosen lane dressing profile program is finished.

When the apparatus of this invention is performing a lane conditioning program, it applies the lane dressing profile as defined in the selected program. A particular program may utilize one or two passes on the bowling lane. One pass is defined as movement of the apparatus from the foul line toward the bowling pins and back to the foul line. Thus, within each pass, there is a period of forward motion (toward the pins) and reverse motion (returning to the foul line). Lane dressing can be applied to the lane with one or two passes, and during either forward or reverse motion. Therefore, a desired lane dressing profile can be created by applying lane dressing in any combination of passes and directions. The final lane dressing profile applied to the lane will be the accumulated result of all lane dressing applications commanded by the program. Within the memory of the CPU, each lane dressing profile is stored as four two-dimensional arrays. One array exists for forward motion in pass one, one array exists for reverse motion in pass one, and two more arrays exist for the forward and reverse motions in pass two, respectively. Each element of each array is the lane dressing unit thickness corresponding to a specific board or zone and to a specific distance from the foul line. By applying lane dressing during the appropriate pass(es) and direction(s), the desired lane dressing profile can be applied to the lane. Since a bowling lane has 39 boards and is 62 feet in length, each of the four arrays may contain 2,418 unit thickness values. According to this scheme, each foot of distance from the foul line corresponds to a single value in each of the arrays. It will be understood by those skilled in the art that other distances from the foul line may be used to build the arrays. For example, a 6 inch length could be used as opposed to a 1 foot length.

Because the pulse valves supply varying quantities of lane dressing as the machine is moved along the bowling lane, the control of lane dressing flow is in "real time;" thus, only the desired metered quantity of lane dressing is applied to the applicator at predetermined times during the movement of the machine.

The lane dressing patterns stored within the memory of the CPU enables an operator of the machine to select the units of lane dressing applied across lateral and longitudinal portions of the bowling lane. This is advantageous over previous prior art methods wherein an operator may have had to determine a specified time for activation of lane dressing application, or to select a particular lane dressing delivery pressure corresponding to a volummetric flow rate. Thus, an operator may simply input information relating to the desired end result as opposed to inputting information to the machine which is not directly indicative of the desired lane dressing pattern.

Figure 17:
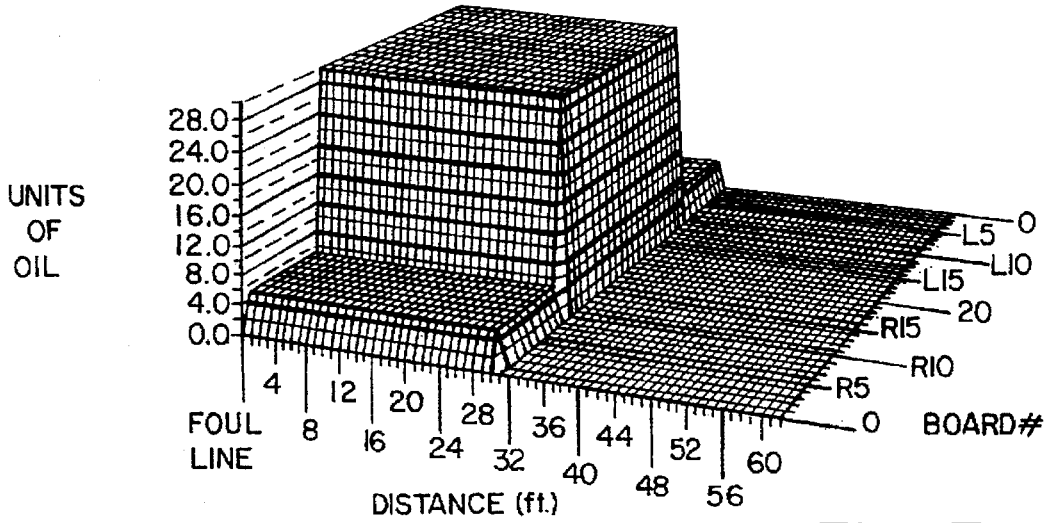
FIG. 17 is a three-dimensional representation of a common "top hat" lane dressing pattern wherein the longitudinal profile of each board viewed individually shows application of a constant amount of lane dressing along a predetermined length of the lane, starting from the foul line, and a lateral lane profile shows an increased amount of lane dressing applied laterally at the center area of the lane.
Figure 18:
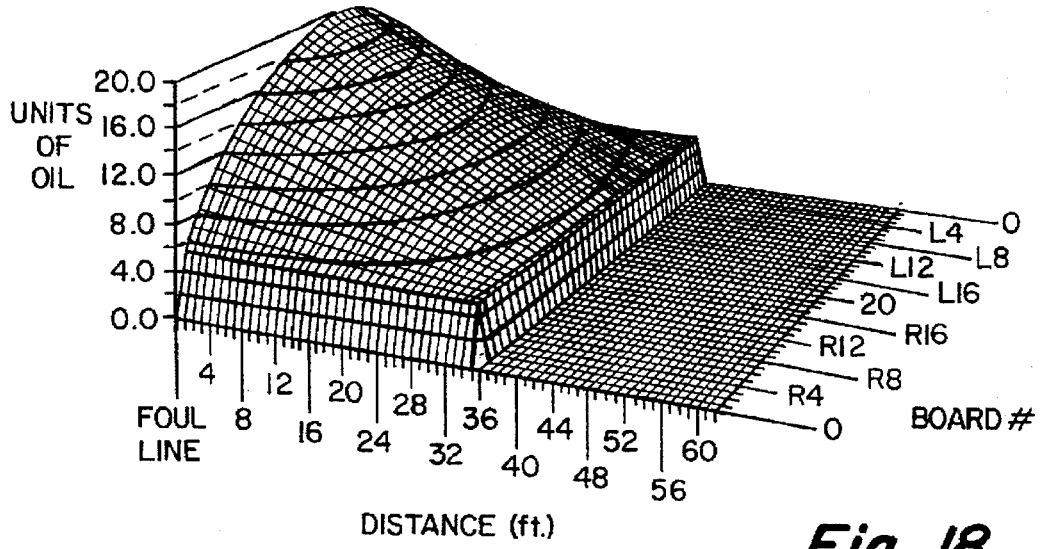
FIG. 18 is a three-dimensional representation of a lane dressing pattern that can be applied by the apparatus and method of this invention wherein there is a decreasing amount of lane dressing applied both laterally across and longitudinally along the bowling lane, starting from the foul lane; the pattern showing a sloping decrease in both the lateral and longitudinal directions.

As shown in FIG. 17, a very simple and common lane dressing pattern, known in the industry as a "top hat," is illustrated. According to this pattern, a constant amount of lane dressing is applied over a specified longitudinal distance when viewing each board separately. The only variation in application of lane dressing is an increase in the amount applied laterally across the lane. A prior art device having a three transfer roller configuration, or any other prior art device having the capability of applying lane dressing along three lateral sections of the lane can produce this "top hat" pattern. However, such prior art machines cannot effectively produce a lane dressing profile as illustrated in FIG. 18. This is due to the fact that there is a sloping decrease in lane dressing applied both laterally across and longitudinally along the lane as measured from the foul line. Thus, unless there is lateral board-by-board control and "real time" application of lane dressing longitudinally along the bowling lane, a lane dressing profile, as illustrated in FIG. 18, is nearly impossible to achieve. With the apparatus and method of this invention, the dressing profile in FIG. 18 is achievable because of the capability of both incremental lateral and "real time" longitudinal control. It will be understood that the lane dressing pattern shown in FIG. 18 may not be an exact representation of a lane profile that is applied by the apparatus and method of this invention because there will be some degree of incremental "stepping" of lane dressing laterally across the lane. This incremental stepping is dependent upon the width of the zone which closely corresponds to the width of the slit in the lane dispensing unit. For example, if the slits are equal to the width of one board on the lane, and the units of lane dressing on the vertical axis of the desired three-dimensional lane dressing patterns are provided in single units, then a corresponding three-dimensional representation of lane dressing actually applied would show some incremental lateral stepping between boards. However, if the slit widths were narrowed to a fraction of a board width, then the desired lane dressing pattern as illustrated in FIG. 18 would more closely match the pattern of lane dressing actually applied.

Another factor which may alter the actual application of lane dressing versus the desired lane dressing pattern is the viscosity of the lane dressing used. As a general rule, higher viscosity lane dressings will tend to not spread out between the boards of the bowling lane and, therefore, the pattern of lane dressing applied will better maintain its initial shape. When using a lower viscosity lane dressing, the lane dressing will have a tendency to flow or run together which, in turn, results in a greater loss of the distinctive pattern applied to the bowling lane.

Figure 19:
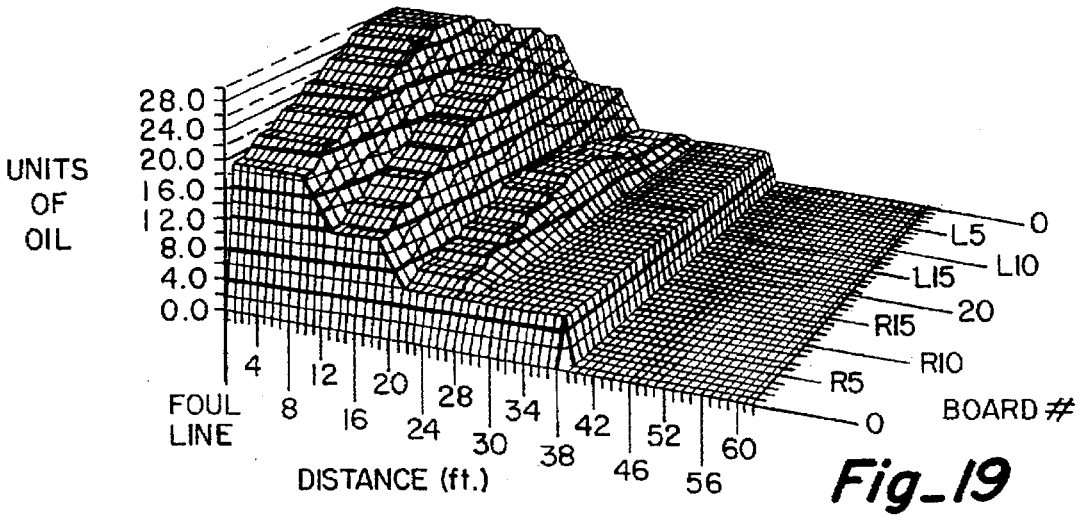
FIG. 19 is a three-dimensional representation of another lane dressing pattern that can be applied by the apparatus and method of this invention wherein unique amounts of lane dressing are provided at specific lateral and longitudinal locations along the bowling lane, along the bowling lane, starting from the foul line; the pattern being symmetrical about the centermost portion of the lane.
Figure 20:
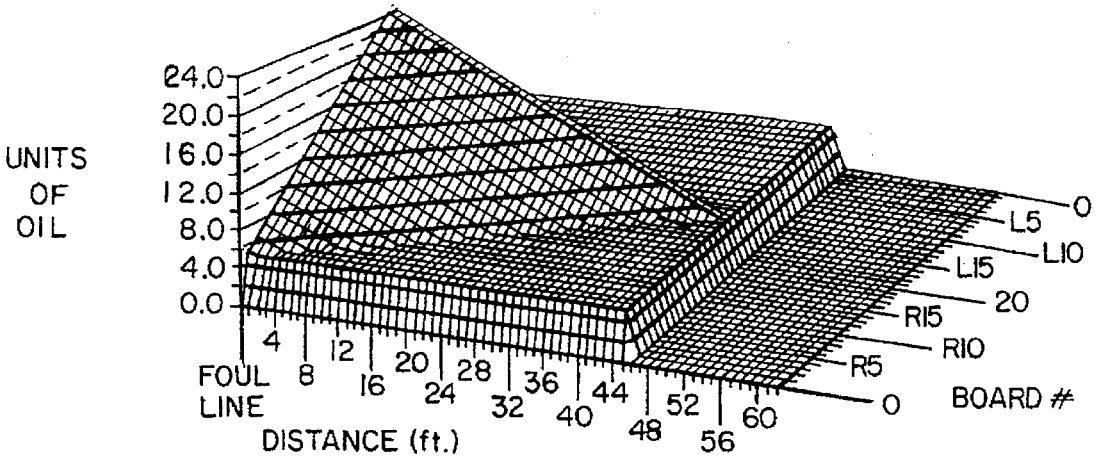
FIG. 20 is another three-dimensional representation of a lane dressing pattern that can be applied by the apparatus and method of this invention wherein a decreasing amount of lane dressing is applied in both the lateral and longitudinal directions along the bowling lane, starting from the foul line; the pattern illustrating a linear decrease in both the lateral and longitudinal directions.
Figure 22:
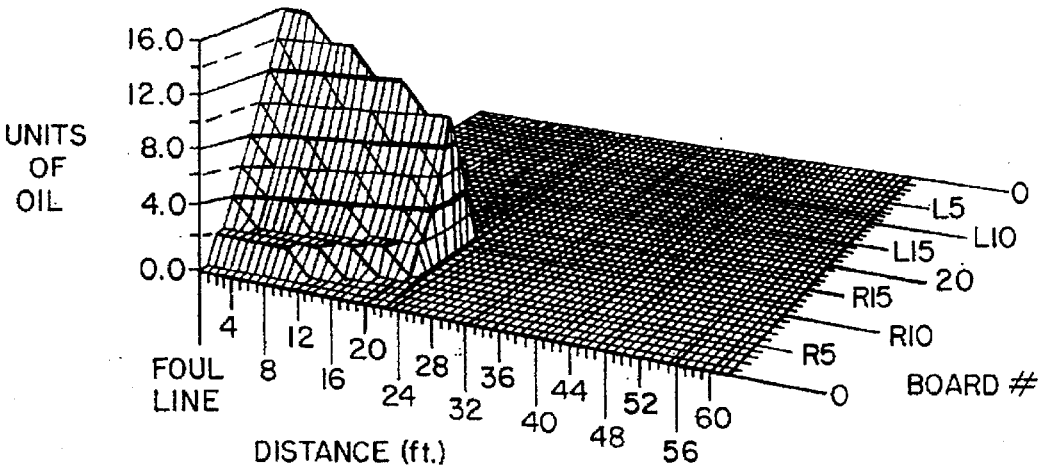
FIG. 22 is yet another three-dimensional representation of a lane dressing pattern that can be applied by the method and apparatus of this invention wherein a common top hat pattern is combined with specified amounts of lane dressing applied laterally across and longitudinally along the bowling lane, starting from the foul line.
Figure 21:
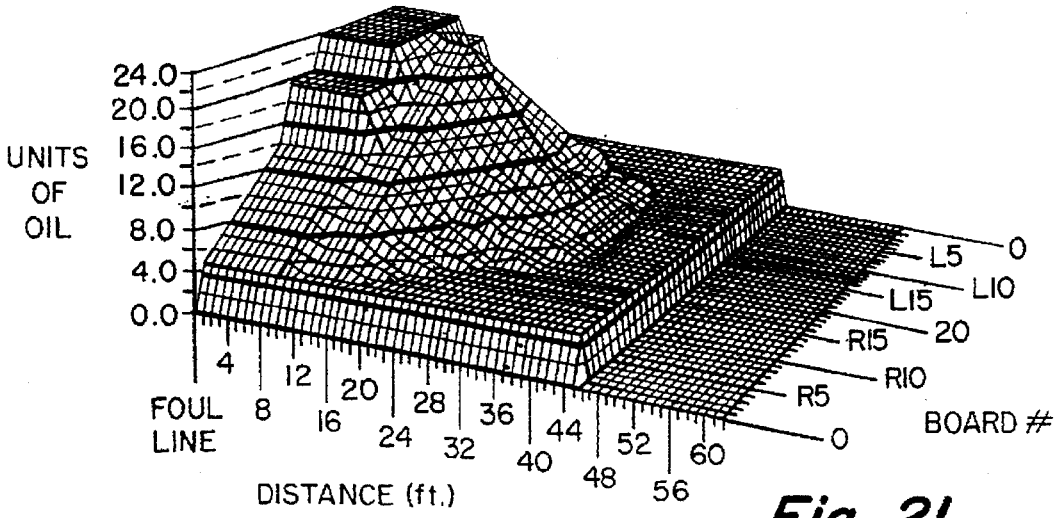
FIG. 21 is yet another three-dimensional representation of a pattern that can be applied by the apparatus and method of this invention wherein a specific amount of lane dressing is applied to only a portion of the bowling lane, starting from the foul line, as for filling in lane dressing at an area which has been worn due to heavy usage.

FIGS. 19 through 21 are other examples of lane dressing patterns which may be achieved by the apparatus and method of this invention. As shown in FIG. 19, the tapering of lane dressing may occur both laterally across and longitudinally along the bowling lane coupled with more or less pronounced steps within the taper. FIG. 20 shows a unique lane dressing pattern wherein there is a linear decrease in lane dressing applied both laterally across and longitudinally along the bowling lane. FIG. 21 is another example of a lane dressing pattern achievable by the apparatus and method of this invention wherein a combined "top hat" profile and taper exists near the foul line with the pattern transitioning into a combination of a linear and step taper combination. FIG. 22 is yet another example of a lane dressing pattern achievable wherein a specified amount of lane dressing is applied only to a confined location on the bowling lane. This pattern can be used to fill in lane dressing that may be worn away due to heavy use by bowlers.

Figure 23:
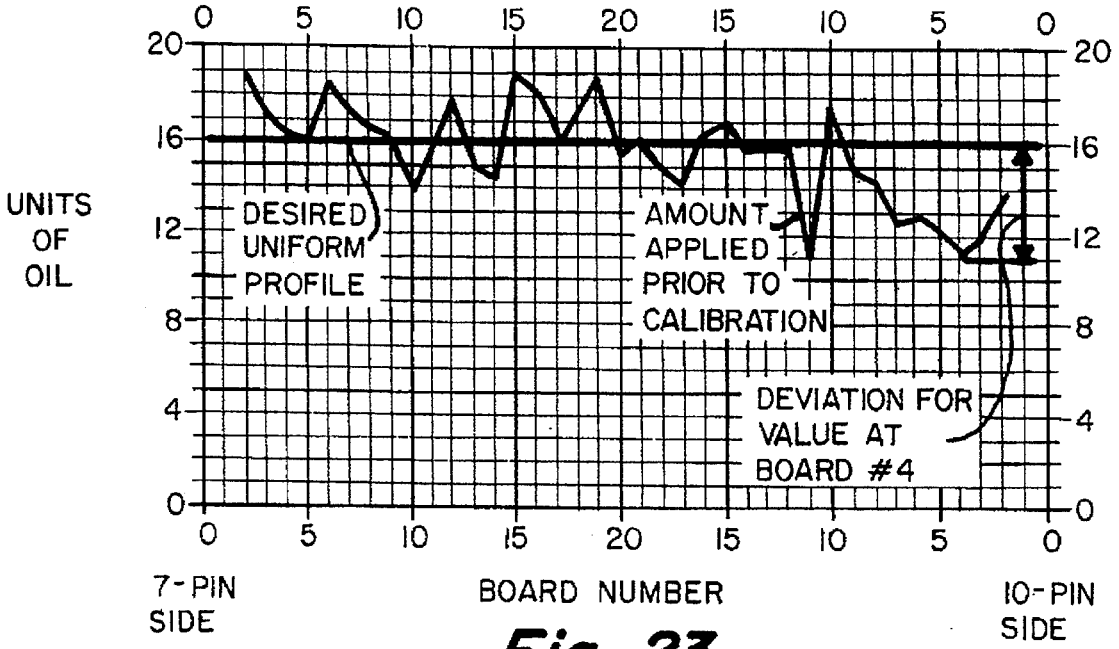
FIG. 23 is a graphical representation of a desired lateral profile and a profile showing an amount that has actually been applied by the machine laterally across the bowling lane prior to calibration.

In order to achieve the complex patterns illustrated in FIGS. 17 through 22, it may be necessary to calibrate the apparatus of the invention disclosed herein prior to use. First, the operator may select a calibration program via the control panel on the machine. The calibration program stored within the CPU of the onboard computer assigns a uniform pulse width modulation value to each of the pulse valves. Precisely calibrated pulse valves provided with the same pulse width modulation (PWM) values should result in the application of a flat and uniform layer of lane dressing. The machine is then activated and lane dressing is applied according to the desired uniform pattern. Once the lane dressing has been applied, a single or a plurality of lengths of calibration tape are placed laterally across the bowling lane at one or more desired longitudinal locations along the bowling lane. The calibration tape is removed from the lane and measurements are made of the amount of lane dressing adhering to the tape. Typically, this measurement may be done by use of the Brunswick Computer Lane Monitor™ Lane Dressing Analysis machine, manufactured by Brunswick Corporation of Muskegon, Mich. This machine is capable of measuring in units of lane dressing the amount of lane dressing adhering to the calibration tape. An example measurement is shown in FIG. 23; the actual units of lane dressing applied across the lane and the desired uniform pattern is shown on a graph in lane dressing units. Once the measurements are taken, data reflective of the measurements may be automatically inputted via a RS-232 communications cable from the Brunswick Lane Monitor™ to the onboard computer. The CPU of the onboard computer calculates the average units of lane dressing delivered for all of the pulse valves. This average amount delivered is stored in the CPU as a conversion factor expressed in the number of pulse width modulation values per unit of lane dressing delivered (PWM/unit). The CPU also compares the desired amount of lane dressing applied versus the measured amount for each pulse valve, and will then calculate a correction factor which corresponds to a change in the output signal sent to each individual pulse valve. In other words, the CPU calculates an adjustment to provide the correct pulse width modulation value to be sent to each pulse valve based upon the conversion factor in order to create the selected lane pattern. Thus, the calibration process identifies small differences between the 39 pulse valves, since some may deliver a little more or less lane dressing than the average of all valves, even with the same pulse width modulation signal. For example, as shown in FIG. 23, an adjustment or deviation of 5 units of oil is needed for the pulse valve corresponding to board number 4, 10-pin side. As discussed above, this identified deviation corresponds to a calculable pulse width modulation value. Once lane dressing is applied, the needed adjustments are apparent when the amount actually applied differs from the desired flat pattern. To arrive at the appropriate pulse width modulation control signal for each of the 39 valves for each array element, the desired lane dressing thickness (from the desired lane profile) is multiplied by the lane dressing conversion factor (PWM/Unit of Lane Dressing Delivered) and the valve correction factor.

As with the graphical data shown in FIGS. 17 through 22, a VGA monitor or liquid crystal display coupled to the onboard computer can be used to display the data shown in FIG. 23 in order to allow the operator to view the desired lateral profile versus the amount actually applied. Normally, it takes three to five iterations of data input to calibrate the machine to a level that applies lane dressing according to some of the more complex profiles as shown in FIGS. 19 and 21. For example, after the bowling lane maintenance machine makes its first pass along the lane and data is sent via the Brunswick Lane Monitor™ to the onboard computer reflective of the actual amounts of lane dressing applied, depending upon the precision and accuracy of the lane dressing applied, the operator may wish to perform another calibration wherein the bowling lane maintenance machine makes another pass along the lane and a second measurement is taken via the Brunswick Lane Monitor™. One advantage of the method of calibration disclosed herein is that the desired end result, i.e., the lane dressing pattern, is the focus of the calibration efforts. That is, other variable factors such as lane dressing viscosity, machine speed, applicator performance, lane dressing delivery pressure and other external factors may be compensated for by adjusting the metered amount of lane dressing discharged by the pulse valves. If only a calibration of the pulse valves were done, then varying external factors such as the retention of lane dressing by the applicator or lane dressing viscosity would not be taken into account. Thus, these external factors could result in application of lane dressing that is not in accordance with the desired lane dressing pattern even though calibration efforts occurred.

An additional advantage of the method of calibration disclosed herein is that the data stored in the memory of the computer for a particular lane dressing profile may be also indicative of the type of delivery pressure used and the particular viscosity of lane dressing utilized. That is, when a calibration is conducted on the machine, the type viscosity oil and delivery pressure provided by the compressor may be recorded which enables the computer to automatically adjust for the application of lane dressing according to a specific delivery pressure or viscosity of oil. For example, if an operator of the machine changes the delivery pressure to the pulse valve, and/or changes the viscosity of the lane dressing used, this information can be input into the computer wherein the adjusted delivery pressure and/or viscosity triggers the computer to send pulse width modulation control signals to each of the pulse valves which compensates for the change in the two variables.

This invention has been described in detail with reference to particular embodiments thereof, but it will be understood that various other modifications can be effected within the spirit and scope of this invention.

I claim:

1. A method of applying lane dressing to the boards of a bowling lane, in both desired lateral increments and desired longitudinal increments along the bowling lane, by an applicator of a bowling lane maintenance machine, which travels along the length of the bowling lane, and includes an onboard computer, said method comprising the steps of:

creating a database array for storage of information reflective of a plurality of lane dressing patterns comprising amounts of lane dressing to be applied in desired lateral and longitudinal increments along the bowling lane;

storing the database array in a memory of the computer;

selecting a desired lane dressing pattern for application of lane dressing laterally across each board of the bowling lane and longitudinally along a selected length of each of the boards;

retrieving selective data from the database array corresponding to the selected desired lane dressing pattern;

providing a plurality of lane dressing dispersion means for discrete and variable volumetric controlled application of lane dressing to the applicator as the bowling lane maintenance machine travels along the length of the bowling lane;

activating the plurality of lane dressing dispersion means responsive to the retrieved selective data wherein activation of the dispersion means occurs repetitively along a predetermined distance as the bowling lane maintenance machine moves along the bowling lane; and selectively applying the lane dressing to the bowling lane according to the desired lane dressing pattern.

2. A method, as claimed in claim 1, wherein:

the selected lane dressing pattern comprises amounts of lane dressing which vary laterally across and longitudinally along the bowling lane according to the desired lateral and longitudinal increments.

3. A method, as claimed in claim 1, wherein:

the amount of lane dressing varies within each lateral and longitudinal increment.

4. A method, as claimed in claim 1, wherein:

the selected desired lane dressing pattern is selected in lane dressing units.

5. A method, as claimed in claim 1, further including:

viewing a visual display coupled to the computer reflective of the selected lane dressing pattern.

6. A method of applying lane dressing in variable lateral and longitudinal increments to the boards of a bowling lane along the bowling lane, by an applicator of a bowling lane maintenance machine including a controller, as the bowling lane maintenance machine moves along the bowling lane, said method comprising the steps of:

selecting amounts of lane dressing to be applied along a lateral portion of the bowling lane;

selecting amounts of lane dressing to be applied along a longitudinal portion of the bowling lane;

providing a plurality of lane dressing dispersion devices for discrete and variable volumetric controlled application of lane dressing to the applicator as the machine moves along the bowling lane;

selectively metering discrete quantities of lane dressing from the dispersion devices onto the applicator in discrete and variable volumetric amounts in a plurality of activations as the bowling lane maintenance machine moves along the bowling lane in response to the selected amounts of lane dressing along the lateral and longitudinal portions; and selectively applying the discrete quantities of lane dressing along predetermined lateral and longitudinal lengths of the bowling lane as the bowling lane maintenance machine moves along the bowling lane.

7. A method, as claimed in claim 6, further including:

viewing a visual display coupled to the controller reflective of the selected amounts of lane dressing to be applied.

8. A method of calibrating a bowling lane maintenance machine having an onboard computer which selectively controls the application of lane dressing onto a bowling lane surface, the machine including a plurality of metering devices which apply metered amounts of dressing to an applicator, said method comprising the steps of:

selecting a desired lane dressing pattern;

applying a predetermined amount of lane dressing according to the selected pattern;

measuring the amounts of lane dressing applied to the bowling lane along a plurality of longitudinally spaced sections extending laterally across the bowling lane;

comparing the measured amounts of lane dressing applied with that of the selected lane dressing pattern to identify any deviation of the measured amount of lane dressing from the selected lane dressing pattern;

inputting data into the computer which is responsive to an identified deviation;

calculating a correction factor via the computer to adjust the metered amounts of lane dressing to be applied to the bowling lane to create the selected lane dressing pattern;

sending controlling signals to the metering devices to control the rate and amount of lane dressing delivered to the bowling lane in response to the calculated correction factor; and applying an adjusted predetermined amount of lane dressing to the bowling lane according to the selected lane dressing pattern.

9. A method, as claimed in claim 8, wherein:

the method claimed therein is repeated until a desired level of calibration is achieved.

10. A method, as claimed in claim 8, further including:

viewing a visual display coupled to the computer of the selected lane dressing pattern.

11. A method, as claimed in claim 8, further including:

viewing a visual display coupled to the controller of the measured amounts of lane dressing applied.

12. A method, as claimed in claim 8, further including:

viewing a visual display coupled to the controller of the comparison between the measured amounts of lane dressing applied and the selected lane dressing pattern.

13. A method of calibrating a bowling maintenance machine having an onboard computer which selectively controls the application of lane dressing onto a bowling lane surface for producing a desired lane dressing pattern, the machine including a plurality of metering devices which apply metered amounts of dressing to an applicator, the onboard computer providing a pulse width modulation signal to each of the metering devices, said method comprising the steps of:

selecting a desired lane dressing pattern;

providing first pulse width modulation signals to each metering device reflective of the selected lane dressing pattern;

applying a predetermined amount of lane dressing according to the selected pattern;

measuring the amounts of lane dressing applied to the bowling lane along a plurality of longitudinally spaced sections extending laterally across the bowling lane;

comparing the measured amounts of dressing applied with that of the selected lane dressing pattern to identify deviations of the measured amounts of lane dressing from the selected lane dressing pattern;

calculating correction factors via the computer to adjust the pulse width modulation signals for each of the metering devices corresponding to identified deviations;

providing second pulse width modulation signals to each metering device corresponding to the identified deviations and reflective of corresponding correction factors; and applying an adjusted amount of lane dressing to the bowling lane according to the selected lane dressing pattern.

14. A method, as claimed in claim 1, wherein said activating step further includes the step of:

applying lane dressing according to the desired lane dressing pattern wherein application of the lane dressing may be varied laterally and longitudinally with respect to at least each board of the bowling lane.

15. A method, as claimed in claim 6, wherein said selectively applying step further includes the step of:

applying lane dressing according to the selected amounts wherein application of the lane dressing may be varied laterally and longitudinally with respect to at least each board of the bowling lane.

* * * * *